166-66

1/29/80 XR 4,185,691

SR

United States Patent [19]

Tubin et al.

[11] 4,185,691

[45] Jan. 29, 1980

[54] SECONDARY OIL RECOVERY METHOD AND SYSTEM

[75] Inventors: E. Sam Tubin, 4419 Fulton Ave., Sherman Oaks, Calif. 91403; Stewart Tongret, Santa Monica, Calif.

[73] Assignee: E. Sam Tubin, Sherman Oaks, Calif.

[21] Appl. No.: 898,709

[22] Filed: Apr. 24, 1978

Related U.S. Application Data

[63] Continuation-in-part of Ser. No. 830,894, Sep. 6, 1977, Pat. No. 4,127,169.

[51] Int. Cl.[2] ..... E21B 33/127; E21B 43/24

[52] U.S. Cl. ..... 166/250; 166/53; 166/60; 166/64; 166/66; 166/302

[58] Field of Search ..... 166/60, 65 R, 59, 57, 166/58, 302, 66; 219/277, 278

[56] References Cited

U.S. PATENT DOCUMENTS

| | | | |
|---|---|---|---|
| 884,645 | 4/1908 | Monroe et al. | 166/58 |
| 1,584,187 | 5/1926 | Monroe | 166/58 |
| 1,661,971 | 3/1928 | Seymour, Sr. | 219/277 X |
| 2,076,669 | 4/1937 | Redfield et al. | 219/277 |
| 2,134,610 | 10/1938 | Hogg | 166/60 |
| 2,881,301 | 4/1959 | Bowman | 166/60 X |
| 3,045,099 | 7/1962 | Bowman et al. | 166/60 X |
| 3,982,591 | 9/1976 | Hamrick et al. | 166/59 X |

*Primary Examiner*—Stephen J. Novosad
*Attorney, Agent, or Firm*—Wills, Green & Mueth

[57] ABSTRACT

A novel method for stimulating the flow of oil from the pay zone of a formation traversed by a bore hole which involves the conversion of liquid water into high pressure steam in situ in heat transfer proximity to the pay zone. A novel oil tool adapted to be lowered and suspended within the bore hole in proximity to the pay zone having an external elongated shell within which is contained means for the in situ generation of steam. The casing may be adapted to generate steam internally and allow that steam to pass through the shell and into contact with the pay zone at a predetermined high pressure, or to superheat highly pressurized water and allow it to pass through an orifice in the shell, at which time it immediately flashes to high pressure steam and disperses into the area of the pay zone. A novel electrical control system for the operation, regulation and malfunction-detection of the oil tool from the ground surface.

29 Claims, 18 Drawing Figures

FIG. — 1
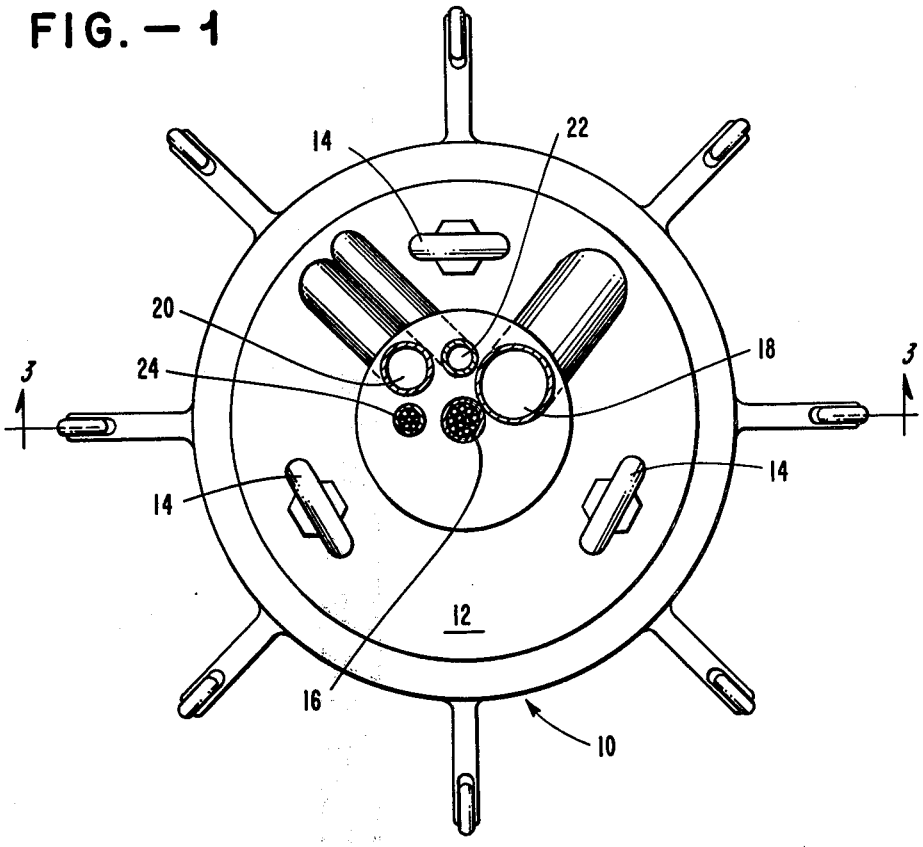
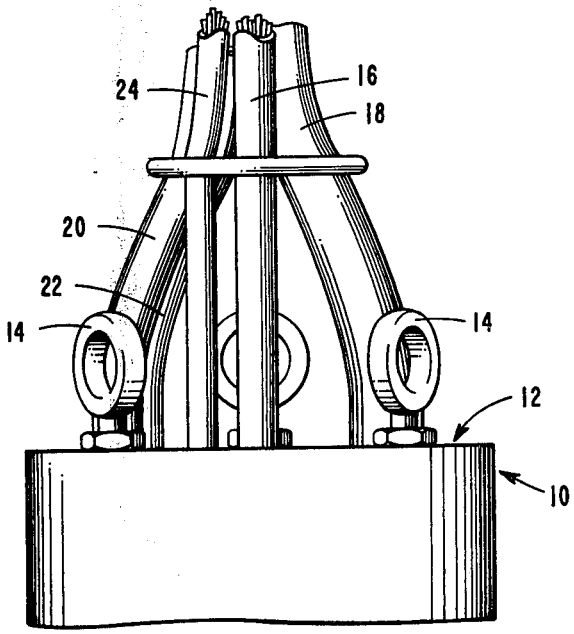
FIG. — 2

FIG.—4
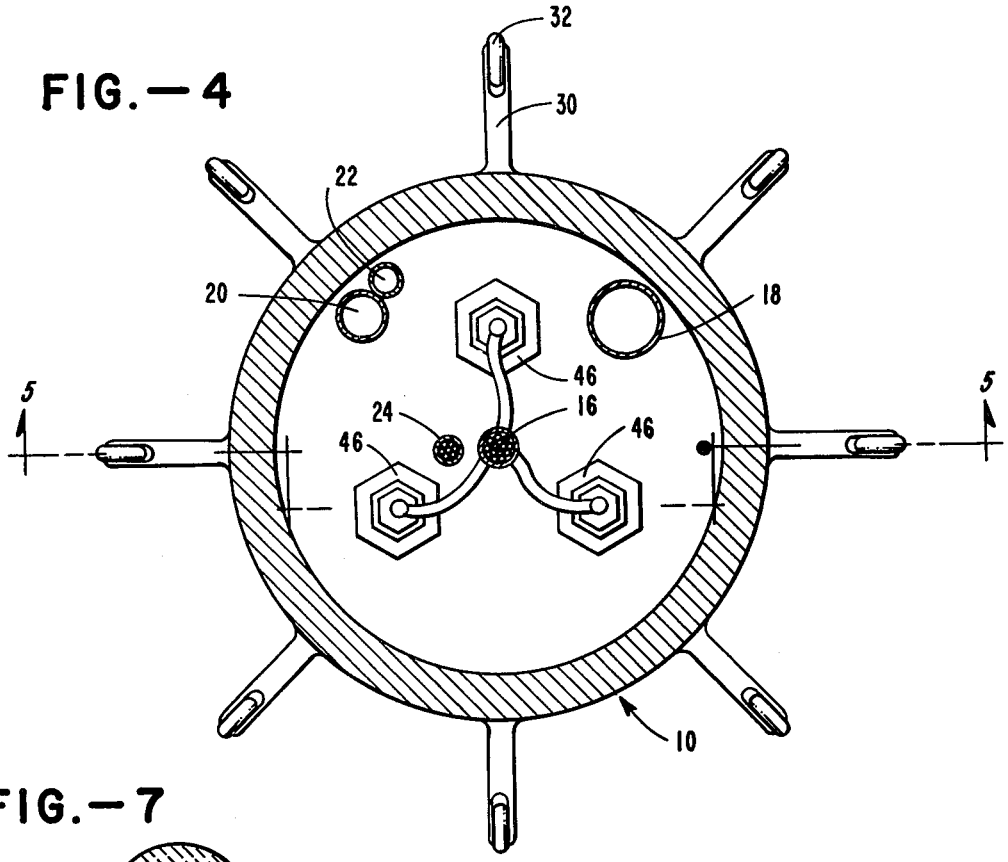
FIG.—7
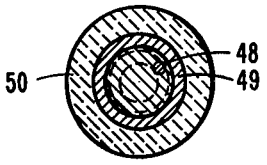
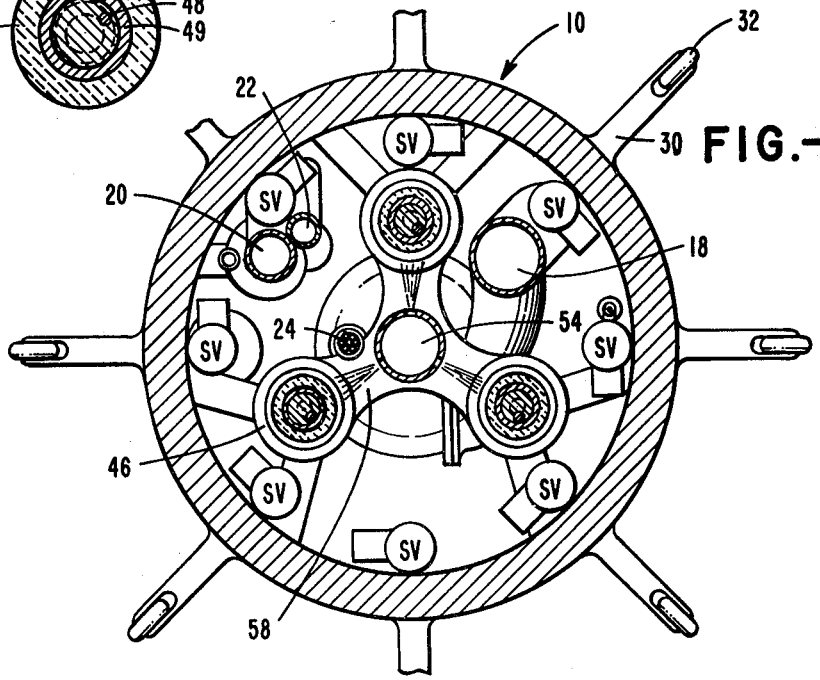
FIG.—6

SECONDARY OIL RECOVERY METHOD AND SYSTEM

REFERENCE TO RELATED APPLICATION

This application is a Continuation-in-Part of copending Application Ser. No. 830,894, filed Sept. 6, 1977, now U.S. Pat. No. 4,127,169, entitled "Novel Secondary Oil Recovery System", the teachings of which are incorporated herein.

BACKGROUND OF THE INVENTION

It is a fact that the primary method of oil production results in the production of only about 5 to 20 percent of the oil present within the formation. Various secondary recovery methods are known. The adoption of secondary recovery techniques has been somewhat inhibited by their low efficiency, high operating costs, and other problems relating to environmental contamination, geological disturbances and the like. One known method of secondary recovery involves the steaming of oil well formations from the surface. The only procedure of that type in common use is referred to as "huffing and puffing". The huff and puff method of secondary recovery using steam is characterized by many serious problems and disadvantages which have particularly plagued the oil industry in the last four or five years during which various developments in the world have focused attention on secondary recovery.

The problems with the huff and puff steaming procedures include the fact that the steam is generated in very large boilers which must operate at temperatures of 500° F. to 900° F. in order to produce the seam at 250° F. to 450° F. required at the pay zone. These large boilers are positioned on the surface and require elaborate site preparation and very expensive equipment to withstand the thermal stresses generated by the temperatures involved. In addition, vast lengths of steam lines are required for distribution of the super-heated steam from the boiler to the various wellheads within the field. The steam lines result in major heat losses which substantially reduce the overall thermal efficiency of the operation. The steam lines, even though provided with numerous expansion loops, are subject to cracking and breaking as a result of thermal stress and vibration.

Another major facet of the problems in that huff and puff steaming procedures are adapted to an absolute maximum well depth on the order of 2500 to 3000 feet and the full length of the well is normally steamed during steam injection. Most of the wells being steamed today are only from about 700 to 1500 feet in depth. Thus, the huff and puff technique is not adapted to the secondary recovery of oil from deeper pay zones. However, there exists in the United States many areas in which the pay zone is deeper than 3000 feet and from which oil is potentially producible.

It has also been previously proposed to inject water into the bore hole and then to heat the water. This procedure is of limited efficacy because the water is not as effective in penetrating many pay zones. Further, the down hole heating of water entails the heating of water admixed with the naturally-occuring fluids including brines and the like which quickly foul or corrode the heating equipment. The water procedure is also depth limited, as previously mentioned.

The present invention represents a major contribution to the art of secondary oil recovery by mitigating or overcoming the many problems associated with the existing steaming techniques. More particularly, by the practice of the present invention it is possible to dispense with elaborate surface site preparation since no large central boiler system is involved in the practice of this invention. The present invention is adapted to be put into operation in most wells without any major advance preparation other than removal of residual fluid, if any, within the bore hole. Further, the practice of this invention makes possible the injection of thermal energy directly into the pay zone at a preselected depth and at the proper temperature usually ranging from 250° F. to 450° F. No distribution system involving steam lines from a central boiler to the wellhead is utilized. Rather, cold water is pumped down the string of tubing into the tool where it is converted into high pressure steam and the steam thus generated is forced out into the formation.

Still further, the practice of the present invention is not limited to any well depth and this invention is fully operable at great depths of 12,000 feet or more where secondary recovery by high pressure steaming has heretofore been impossible. Thus, in short, the present invention is adaptable to a greater range of well depths, provides greater thermal efficiency through the elimination of heat losses, and obviates the need for elaborate, costly and potentially hazardous surface steam distribution systems.

It is to be anticipated that this invention and the modifications thereof which will occur to those skilled in the art will be rapidly adopted in the petroleum industry.

SUMMARY OF THE INVENTION

Briefly, the present invention comprises the method of stimulating the flow of oil in a formation traversed by a bore hole to cause the migration of the oil into the bore hole where it is recoverable to the surface by conventional techniques comprising generating steam in situ within the bore hole from surface supplied water in heat transfer proximity to the pay zone of said formation.

This invention further comprehends the method of stimulating the flow of oil in a formation traversed by a bore hole to cause the migration of the oil into the bore hole where it is recoverable to the surface by conventional techniques comprising generating steam in situ within the bore hole in heat transfer proximity to the pay zone of said formation wherein the formation of steam in situ is carried out by an apparatus capable of monitoring at least one variable condition in its own operation and automatically altering that operation according to the status of that variable condition at a given time.

This invention still further comprehends a novel oil well tool for generating steam in situ within a bore hole in heat transfer proximity to the pay zone of said formation and directing said steam in a downward direction from said tool.

This invention still further comprehends a novel oil well tool comprising an external elongated shell adapted to be received in the bore hole traversing an oil field, said shell being substantially impervious to and a barrier against the ambient fluids within a bore hole; within said vessel, surfaces adapted to be heated to temperatures sufficient to convert liquid water into steam; means for introducing liquid water into said vessel through the upper end wall thereof; means for heating said surfaces; and pressure sensitive outlets in said shell whereby high pressure steam generated within the shell can flow through the shell, said shell in the region exposed to high pressure steam being adapted to withstand said pressure.

This invention still further comprehends a novel oil well tool comprising an external shell adapted to be received in the bore hole traversing an oil field, said shell being substantially impervious to and a barrier against the ambient fluids within a bore hole and having a cavity adapted to hold a volume of liquid water under high pressure and to communicate with the bore hole through at least one orifice, means for introducing liquid water into said shell at high pressure through the upper end wall thereof; within said shell, means for heating a body of liquid water under high pressure to temperatures sufficient to cause the liquid water to flash to high pressure steam upon exiting the cavity; whereby high pressure liquid water heated within the shell to a high temperature is forced out the orifice into the bore hole and flashes into high pressure steam, said shell in the region exposed to high pressure steam being adapted to withstand said pressure.

This invention still further comprehends a novel oil well tool for generating steam in situ within a bore hole in heat transfer proximity to the pay zone of said formation which includes a device capable of monitoring at least one variable condition such as temperature, pressure, water purity or electrical power level in the operation of said tool, and automatically altering that operation according to the status of that variable condition over a period of time.

It is an object of the present invention to provide a novel means for the secondary recovery of oil.

It is another object of this invention to solve and reduce the problems which inhere in the existing steam injection and hot water methods of secondary recovery.

More particularly, it is an object of the present invention to provide for the secondary recovery of oil in a more efficient way, to enable such recovery to be carried out in wells of greater depth, and to permit secondary recovery without elaborate and expensive steam generating and distribution systems through the in situ conversion of liquid water to steam within the bore hole adjacent the pay zone, that is, in heat transfer proximity thereto.

Still another object of the present invention is the provision of a novel tool adapted to be lowered and suspended within the bore hole traversing a formation having a pay zone, and in proximity to the pay zone, said tool having means within it for the in situ conversion of liquid water to steam whereby said steam is emitted at high pressure from the interior to the exterior of the tool to be available for contact with the formation at or in proximity to the pay zone.

Yet another object of this invention is a novel electrical operation, control and malfunction-detection system whereby the operation and monitoring of the tool when in position within the bore hole in proximity to the pay zone can be carried out from the ground surface near or adjacent to the wellhead.

These and other objects and advantages of this invention will be apparent to those skilled in the art from the following detailed description and the accompanying drawings.

DESCRIPTION OF THE PREFERRED EMBODIMENTS

FIG. 1 is a top view of the external surface of the shell of the novel oil tool of this invention;

FIG. 2 is a side elevation showing one embodiment of the upper portion of the novel oil tool of this invention;

FIG. 4 is a cross-sectional view which shows a sectional view of the novel tool taken along the line 4—4 in FIG. 3;

FIG. 6 is a cross-sectional view of the novel oil tool taken along the line 6—6 in FIG. 5;

FIG. 7 is a cross-sectional view taken along the line 7—7 in FIG. 5;

Figure 2A:
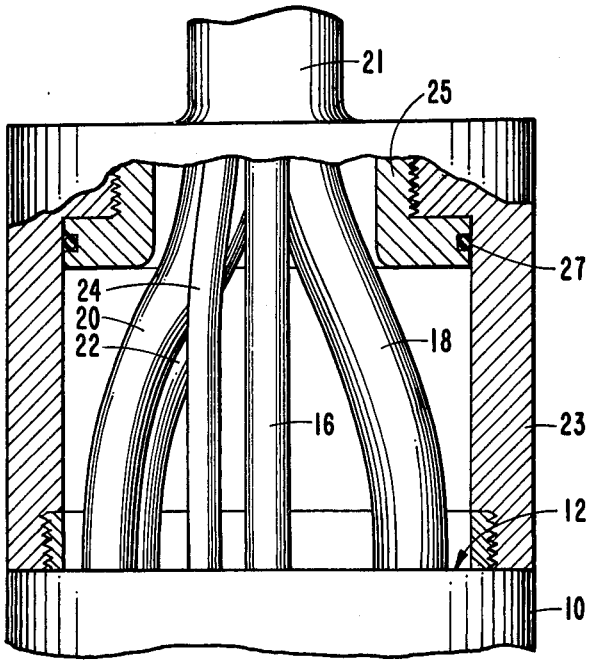
FIG. 2A is a side elevational view of an alternative embodiment of the upper portion of the novel oil tool of this invention.

Turning to the drawings in greater detail, the outer shell or casing 10 is normally made of steel and completely encloses the oil well tool or probe about to be discussed and shown in a first embodiment at FIGS. 1 through 8, inclusive. The upper end 12 of the shell is provided with one or more lifting attachments 14 to which cables or other hoisting means would normally be attached for lowering, holding or raising of the tool within the bore hole. The upper end 12 is also provided with fluid-tight passages through which may pass high voltage electrical conductors (passage 16), treated water (passage 18), an air line (passage 20), a vacuum line (passage 22) and the electrical line to temperature and pressure sensors (line 24) which carries a plurality of electric wires to these sensors or detectors as subsequently described.

FIG. 2A illustrates a second embodiment of the upper portion of the tool wherein the various passages are contained within a single conduit 21 which extends upward through the well casing from the shell 10. The interior of the conduit 21 is sealed from fluids present within the well casing by a collar 23 and an annular adaptor element 25 threadingly engaged therewith, the combination of which extends from the surface 12 of the shell 10 to the base of the conduit 21. One or more O-rings 27 provide a positive seal between the various parts upon assembly.

Figure 3:
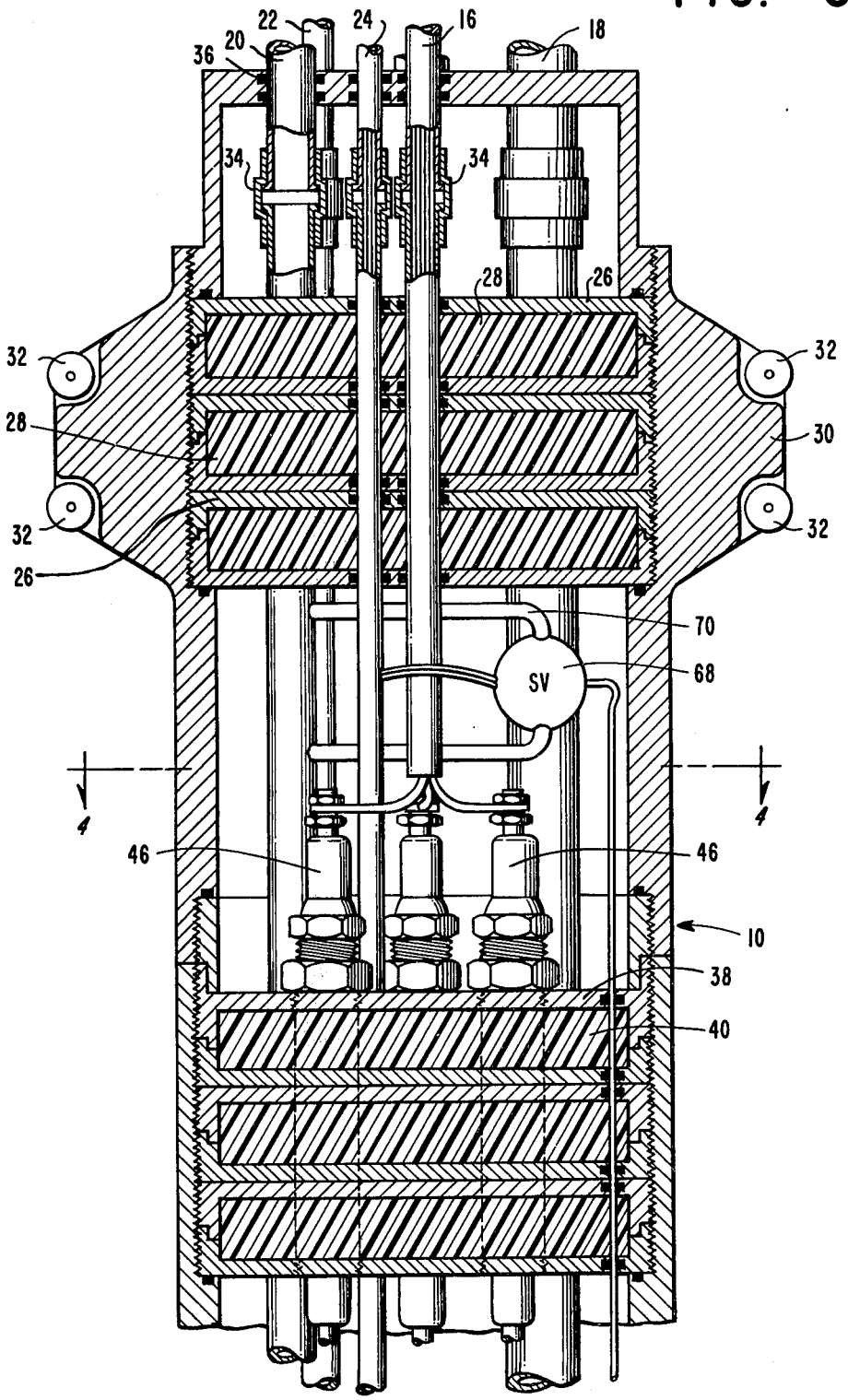
FIG. 3 shows a longitudinal sectional view of one embodiment of the upper portion of the novel oil tool taken along the line 3—3 in FIG. 1.

With further reference to FIG. 3, the interior of the shell 10 is provided with a plurality of transverse metal elements 26 between which are sandwiched asbestos or foamed plastic insulating elements 28 which are effective to prevent unwanted heat loss in an upward direction from the tool when the tool is disposed within the bore hole in proximity to the pay zone. The exterior of the shell 10 may be provided with locating spiders 30 which are adapted to abut the metal casing which typically lines the bore of a finished well, this metal well casing usually being cemented into place and perforated at the pay zone. The locating spiders 30 maintain the alignment of the tool within the casing lining and bore hole. The spiders may also carry rotatable wheel-like elements 32 which facilitate the carrying of the tool over pipe joints, that is, joints in the well casing, during the raising and lowering of the tool within the bore hole.

The various lines and passages 16, 18, 20, 22 and 24 are each provided with expansion couplings 34 and "O-rings" seals 36 which compensate for the effect of thermal expansion on these elements while maintaining the security of shell 10 against the incursion of foreign matter such as naturally-occurring formation fluids.

If desired, the shell 10 has a second series of transverse metal members 38 and insulation layers 40; this second set of transverse members may or may not be present depending upon the desired overall length of the tool. Likewise, depending upon the length of the tool there may be provided on the outside of casing 10 a second set of spiders 42 and wheel-like elements 44 which function in the manner previously described.

As shown in the lower portion of FIG. 3, the electrical conduit 16 supplies electrical energy to the three electrodes 46. These electrodes, typically, are resistance heating elements 48 encased in an electrically conductive metal 49 so that electricity is conducted between the three electrodes through the liquid water phase. If desired, the upper part of electrodes 46 can be provided with an outer protective ceramic coating 50 which prevents attack on the metal by the steam.

Figure 8:
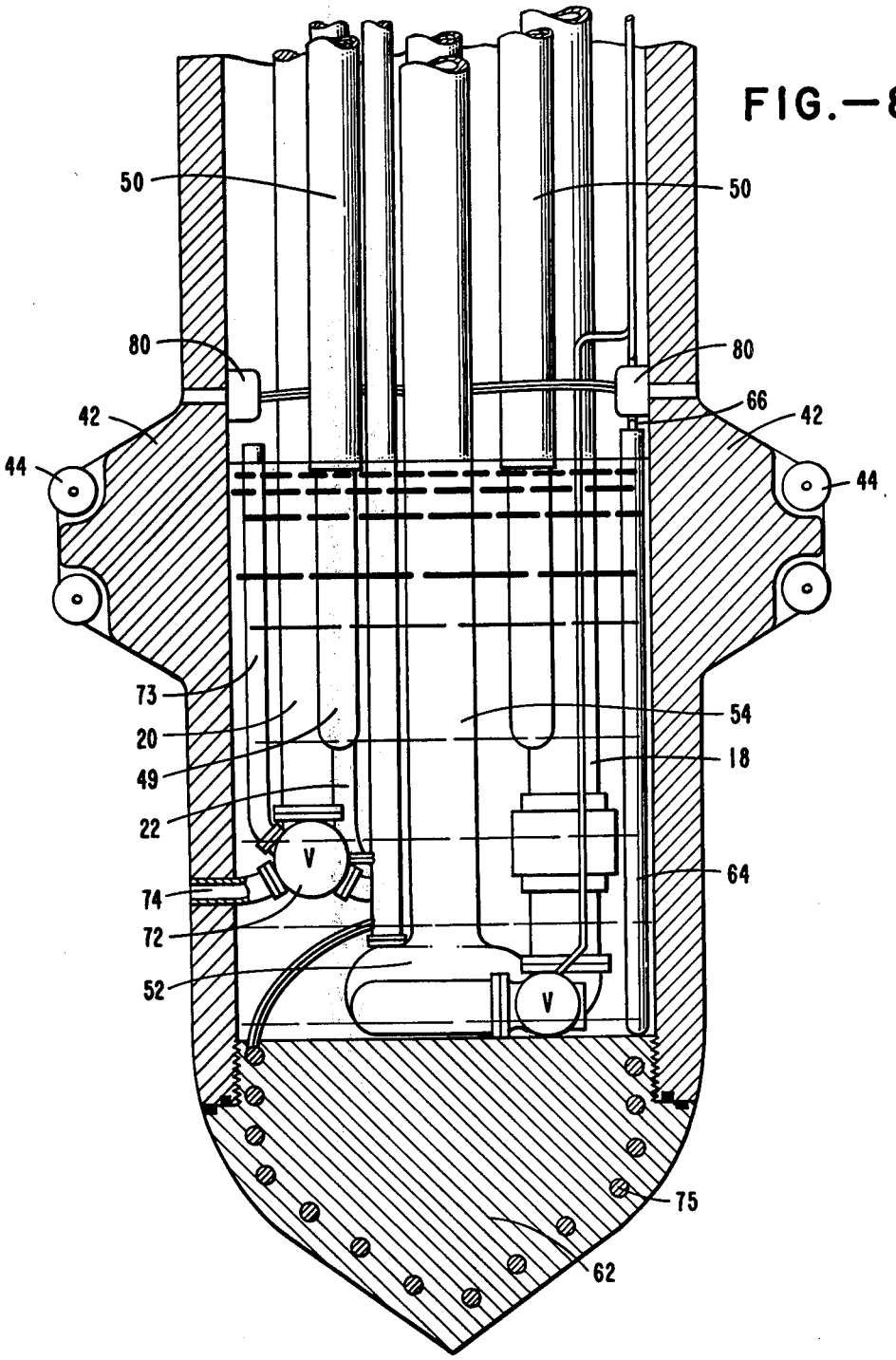
FIG. 8 is a longitudinal sectional view of the novel oil tool showing the portion disposed immediately below that shown in FIG. 5, the view of FIG. 8 being the bottom-most portion of the tool.

The walls of casing 10 and the balance of the tool, at least throughout the steam-containing zone around the heating elements 44, is of heavy-wall construction adapted to maintain steam under pressure at temperatures of at least 500° F. since this portion of the tool is, in effect, a self-contained steam boiler. Thus, the walls of casing 10 around the heating elements 46 must be able to withstand high pressure of at least 400 psig and preferably on the order of 3000 psig. The water passing down treated water inlet passage 18 is then pumped by submergible return pump 52 as shown in FIG. 8 and pumped upwardly in riser 54. The water emerging from the outlet holes 56 is in droplet or spray form, and the water is in spray form at the time it impinges upon the protectively coated resistive heating elements 48 of the electrodes 46. Lateral support elements 58 are provided between riser 54 and electrodes 46, with appropriate electrical and thermal insulation as required. The conical perforated diffusion member 60 breaks up any condensate into drops. The water level liquid in casing 10 is maintained as shown in FIG. 8 at a level above the lower end of the heating elements 48. Also as can be seen in FIG. 8, the submerged pump 52 is supported by transverse surface 62. Water level sensor 64 communicates via line 66 to air-operated solenoid valve 68 in water line 18, the air for its operation being provided via line 70 from air line 20. The line 20 terminates at three-way valve 72 which communicates with outlet 74 for the sampling of fluids within the well bore hole around the outside of casing 10, the sample being blown upwardly by air through vacuum line 22. The three-way valve also can be used to vent the air from inside shell 10 at start-up via line 73.

If desired, the lower end of shell 10 can be provided with an auxilliary electric heating element 75 which would find particular application and more rapidly bring the tool to a steady-state operating condition upon start-up.

It is important to note that the boiler portion of the casing 10 is provided with steam outlets 76 which are controlled by valve regulators 78. The regulators 78 are set so that they open only at some predetermined pressure substantially in excess of the outside pressure exerted by the formation fluids when the tool is down hole adjacent the pay zone. Thus, the valve regulators 78 prevent the intrusion of unwanted naturally-occurring formation fluids into the boiler area and such naturally-occurring fluids do not have an opportunity to foul or contaminate the boiler including the heating elements 48. The steam emitted by outlets 76 passes directly into the bore hole and it is this steam which penetrates the formation to encourage and facilitate the migration of oil from the pay zone into the bore hole. During steaming, a standard blow-out preventor is positioned in the well casing above the tool in this embodiment to prevent the steam from blowing up the well casing, and to make sure the steam is forced into the pay zone.

The interior of shell 10 is provided with a plurality of pressure and temperature sensors 80 which are electrically connected to the system at the ground surface via line 24, as will be described herein. The sensors 80 are of the resistive type and are adapted to sense the pressure or temperature, as the case may be, either inside or immediately outside the shell 10.

Figure 5:
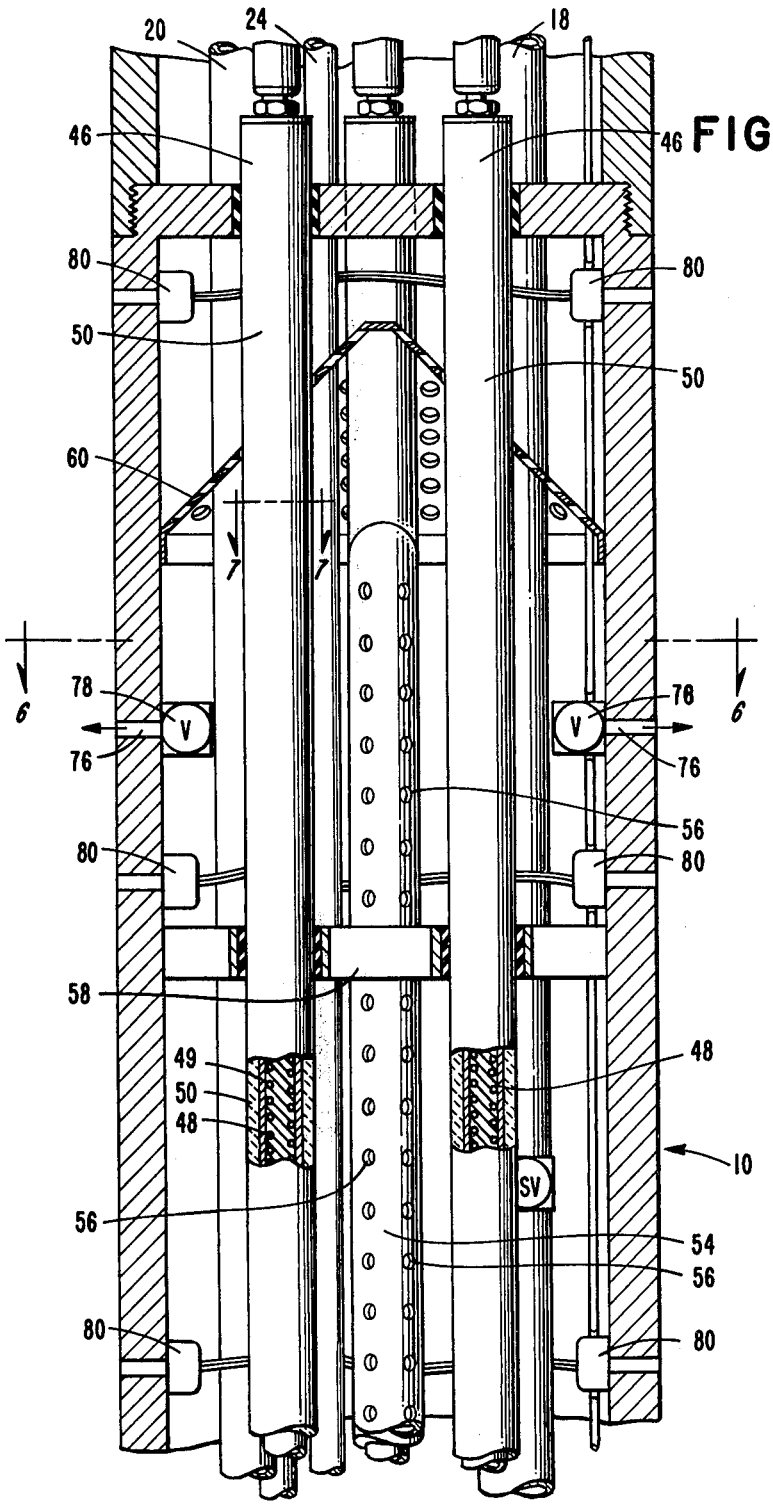
FIG. 5 is a longitudinal sectional view of the oil tool and is a continuation of the view shown in FIG. 3, that is, the view is taken immediately below the view of FIG. 3 and is taken along the line 5—5 in FIG. 4.
Figure 5A:
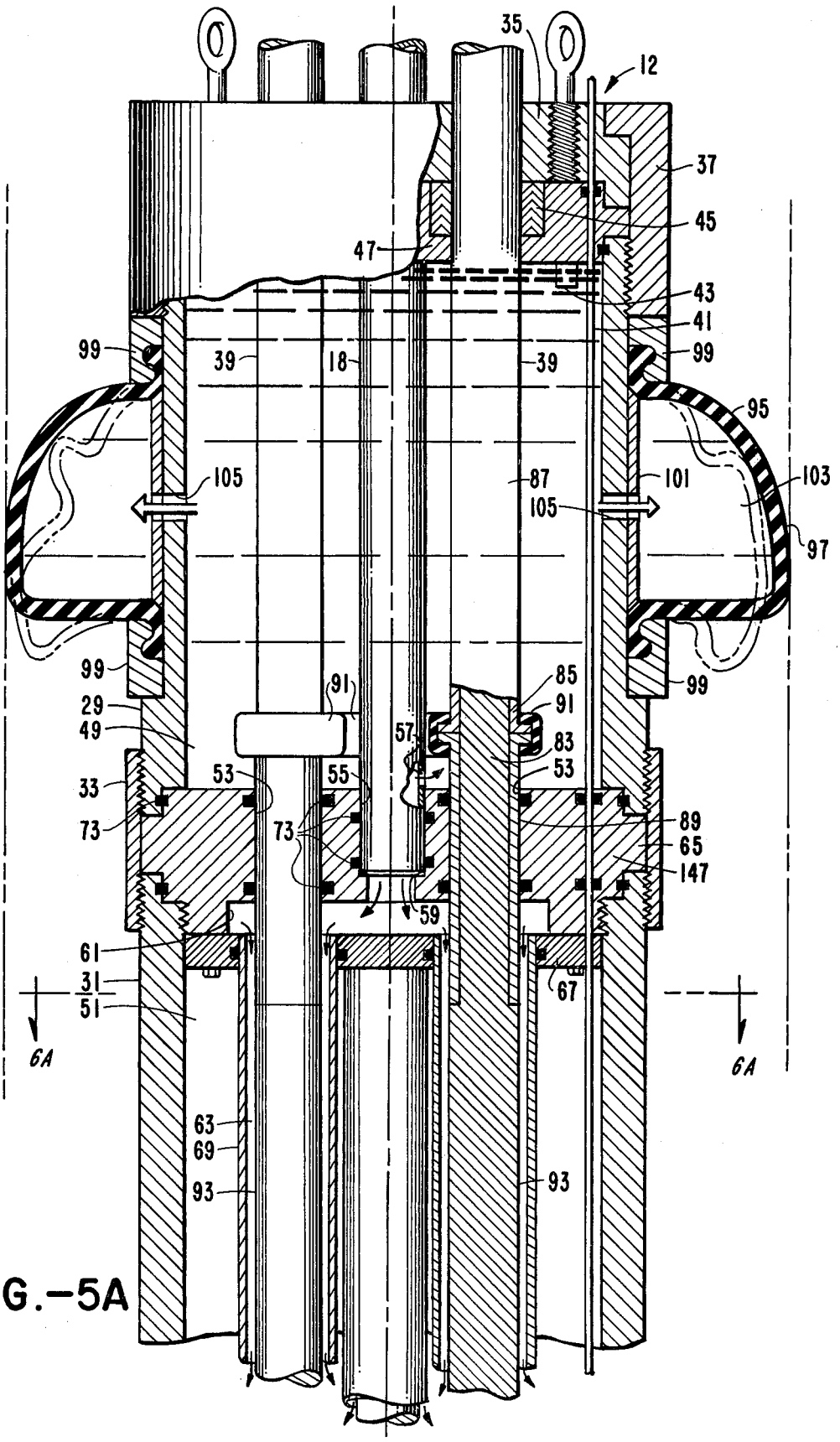
FIG. 5A is a longitudinal sectional view of an alternative embodiment of the upper portion of the novel oil tool taken along the line 3—3 of FIG. 1.

FIG. 5A shows an alternative embodiment of the shell 10 of the present invention. The shell 10 generally comprises an upper cylindrical wall element 29 joined in a coaxial abutting relationship to a lower wall element 31 by an external collar 33. The upper end of the upper wall element 29 is closed by an end plate 35 located within a radial plane and clamped in place by a clamp ring 37 which is threaded onto the upper wall element 29. The outer surface of the end plate 35 thus forms the upper end 12 of the shell 10.

Three electrical conductor elements 39 extend through the passages 16 of the end plate 35 and into the shell 10 itself in a direction parallel to the axis thereof. Above the end plate 36, the conductor elements 39 may extend to the surface of the earth as discrete elements, as shown in FIG. 5A, or may be joined above the surface 12 to form the group of conductors 16 shown in FIGS. 2 and 2A. In either event, three separate conductive paths for the conductor elements 39 are provided from the shell 10 to the surface of the earth. The treated water passage 18 passes centrally through the end plate 35 and into the shell 10 along the axis thereof. Electrical lines to a temperature sensor 41 and a pressure sensor 43 also extend through the end plate 35 to the interior of the shell 10. Each of the elements passing through the end plate 35 is provided with a fluid-tight chevron type packing 45 carried by a seal plate 47 located directly below the end plate 35 and sandwiched at its edge between the end plate and the upper wall element 29. The chevron packings 45 are of conventional design and are capable of preventing the passage of fluid at very high pressure.

An injector plate 147 oriented along a radial plane is sandwiched at its outer edge between the upper and lower cylindrical wall elements 29 and 31, separating the interior of the shell 10 into an upper chamber 49 and a lower chamber 51. The electrical conductor elements 38 extend through openings 53 in the injector plate 147 from the upper to the lower chamber. The water pipe 18 extends into an opening 55 within the injector plate 147 and terminates therein. It is provided with at least one aperture 57 above the injector plate 147 for the supply of water to the upper chamber 49, and an open lower end 59 communicating with a manifold cavity 61 of the injector plate. The water pipe 18 supplies water through the open end 59 to the manifold cavity 61 which distributes the water to a series of annular flow chambers 63 longitudinally of and directly about the lower ends of the electrical conductor elements 39. The injector plate 147 may be composed of an upper portion 65 and a lower closing plate 67 bolted or otherwise connected together to form the manifold cavity 61. This two-piece construction enables the injector plate 147 to be easily and accurately machined from a high-strength material such as stainless steel. The annular flow chambers 63 may comprise a series of metallic sleeves 69 which are sealingly attached to the closing plate 67 in communication with a series of openings therein and positioned coaxially about the electrical conductor elements 39. The sleeves 69 terminate adjacent to the lower ends of the conductor elements 39 in open ends 71. A plurality of O-rings 73 are provided to seal the openings 53 about the conductor elements 39, the opening 55 about the water pipe 18 and the outer surfaces of the injector plate 147 relative to the upper and lower wall elements 29 and 31.

Figure 8A:
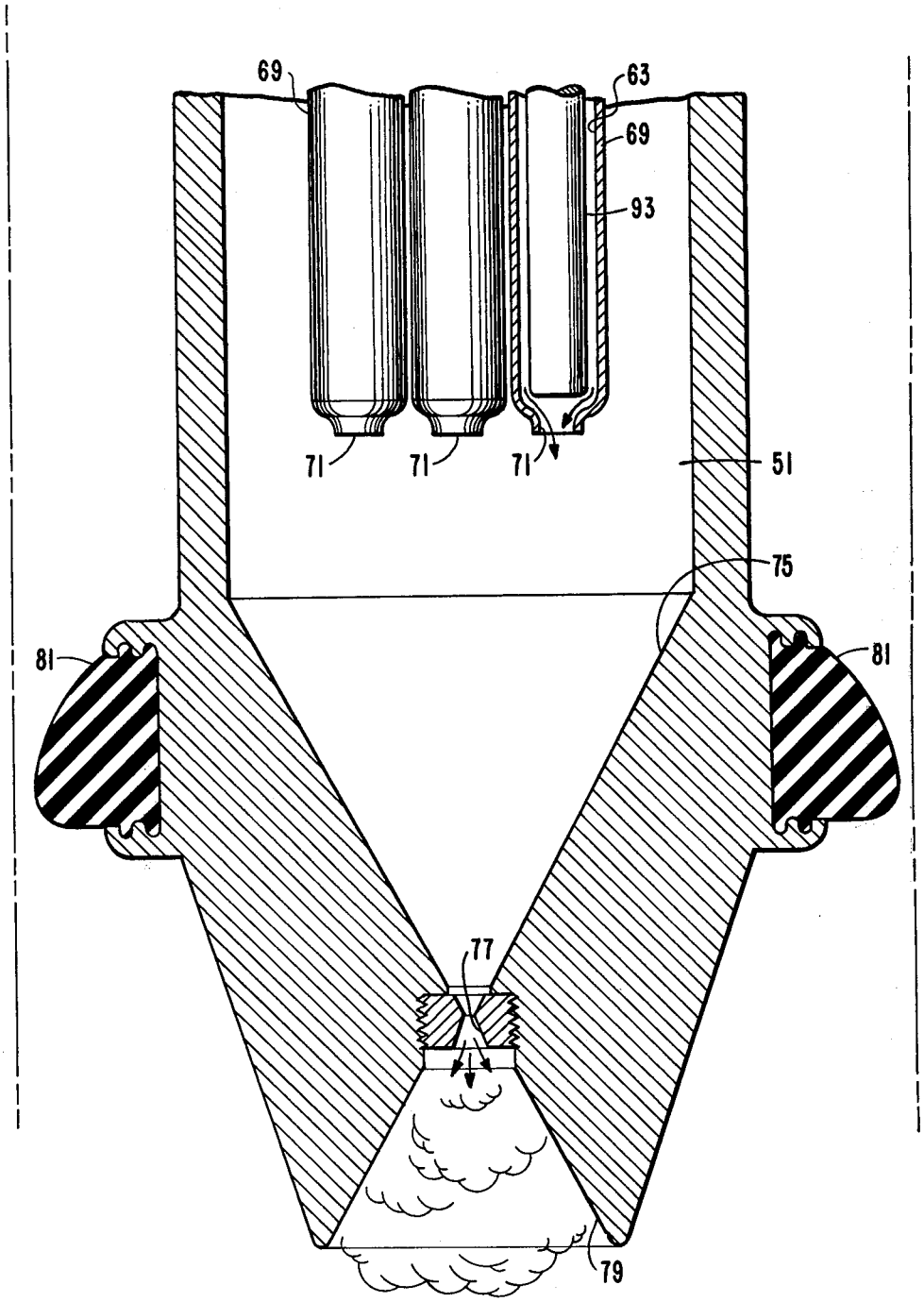
FIG. 8A is a longitudinal sectional view of the novel oil tool of FIG. 5A showing the portion disposed immediately below that shown in FIG. 5A, the FIG. 8A being the bottom-most portion of the tool.

The lower portion of the chamber 51, as seen in FIG. 8A, tapers inwardly toward the axis of the shell 10 to form a conical inner wall portion 75 terminating in an axially aligned orifice 77 which passes through the shell 10. Below the orifice 77, the axially inner surface of the lower wall element 31 flares outwardly to form a similar but opposite conical wall portion 79. The portion containing the orifice 77 may be threadingly disengageable from the remainder of the shell 10 to enable it to be made of a special hardened metal and to facilitate easy replacement in the event that the orifice becomes damaged or an orifice of a different diameter is desired.

The exterior of the shell 10 adjacent to the conical portion 75 is provided with three bumpers 81 having removable tips made of a durable rubber compound such as "Viton". The bumpers 81 serve the dual purpose of centering the shell 10 in the oil well casing and preventing damage either to the shell 10 or the well casing from contact therebetween.

Figure 6A:
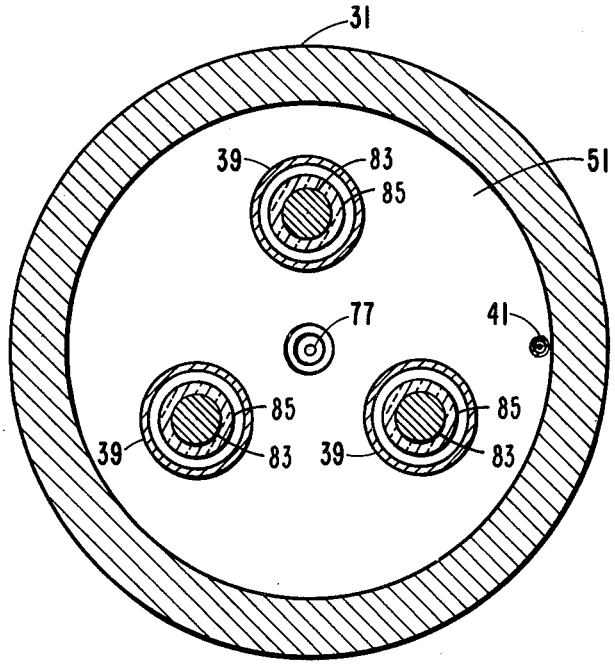
FIG. 6A is a cross-sectional view of the novel oil tool of FIG. 5A taken along the line 6A—6A thereof.

The electrical conductor elements 39 are arranged within the shell 10 in the triangular configuration shown in FIG. 6A. Each of the conductor elements 39 has a solid core 83, preferably made of copper or another highly conductive metal, which is clad along the upper portion of its length with an insulator 85, preferably formed of a ceramic material such as aluminum oxide. For ease of assembly, the insulator 85 is made in two pieces. The upper portion 87 extends down through the end plate 35 to a point just above the injector plate 147. The lower portion of the insulator is a short bushing element 89 which abuts the upper portion 87 and extends through the opening 53 in the injector plate. It terminates at a point below the injector plate. The upper portion 87 and the bushing element 89 are provided with corresponding annular flanges at their point of abutment. The seam between the two flanges is sealed with a rubber sleeve 91 which is fitted thereover and heat shrunk in place, said sleeve preferably being made of a durable rubber material such as Viton. The insulator 85 thus electrically insulates the copper core 83 from water within the upper chamber 49 while allowing electrical contact between the copper core 83 and water within the annular flow chambers 63. The cores 83 may be of a somewhat increased diameter below the insulator 85 to form electrodes 93 having a somewhat greater surface area.

It is to be understood that the number and spacing of the electrodes 93 in a particular shell 10 may be changed by replacing the end plate 35, the seal plate 47, and the injector plate 147 with corresponding elements having the desired number and configuration of openings. The dimensions of the electrodes 93 and the orifice 77 can also be varied by replacement of those components. In this way, the steam production characteristics of the tool can be altered, as desired.

An expandable seal 95, shown in FIG. 5A, comprises a flexible imperforate annular seal member 97 extending about the shell 10 and having upper and lower edges clamped to the shell 10 in fluid sealing relation. The edges are held against the shell 10 by a pair of annular seal rims 99, said seal rims being urged together by the threading engagement of the clamp ring 37 with the upper wall element 29. A sleeve 101 having tapered upper and lower edges is located about the upper wall element 29 and between the two edges of the seal member 97 to serve as a wedge forcing those edges against the seal rims 99 in a fluid sealing relation. The tapering of the sleeve 101 also protects the seal member 97 from being cut or torn upon tightening. The interior 103 of the expandable seal 95 communicates with the upper chamber 49 through a plurality of aligned openings 105 in the upper wall element 29 and the sleeve 101.

The three electrical conductor elements 39 may be connected to a three-phase power supply in either a "Y" or a "Δ" mode. In either case, the metallic sleeves 69 are grounded to provide electrical current flow between the electrodes 93 and the metallic sleeves. The current therefore arcs or otherwise flows across the annular flow chambers 63 and through the resistive water therein.

The temperature sensor 41 and the pressure sensor 43 may be of any conventional type, such as a thermocouple and transducer arrangement, respectively. The pressure sensor 43 extends below the seal plate 47 and senses the pressure within the upper chamber 49. One or more similar pressure sensors for the lower chamber 51 may also be provided, however the pressure value will be essentially the same due to fluid communication between the upper and lower chambers through the aperture 57. The temperature sensor 41 extends from the seal plate 47 through the upper chamber, the injector plate 147 and the lower chamber. It may thus include a plurality of individual sensing elements to sense temperatures of both the upper and the lower chambers, the more important of which is that of the lower chamber which is heated by the electrodes 93.

In operation, high pressure conditioned water from the surface of the earth is supplied to the chambers 49 and 51 through the water passage 18. The water supply is preferably pressurized to approximately 2000 psi and preheated to a temperature of 400° F. The water initially introduced fills the upper and lower cavities through the aperture 57 and the manifold 61, respectively. As this is taking place, a small amount of water drains from the orifice 77. When the chamber 49 is filled to the level of the openings 105, the seal 95 begins to expand and is pressed against the interior of the well casing. The seal 95 is expanded with the pressure of the incoming water when the two chambers are completely full. The water in the upper chamber 49 is from this point on essentially static, while water from the passage 18 continues to be forced through the manifold cavity 61 and along the annular flow chamber 63 at a rate equal to the rate at which water is forced downward through the orifice 77. At this point, the pressure sensor 43 signals to the operator at the surface that the shell 10 is entirely full and is prepared to be heated. The tool is then placed in its operating mode with three-phase electrical power applied to the conductor elements 39 to cause a current to flow between the electrodes 93 and the metallic sleeves 69. That current passes through the water flowing within the annular flow chamber 63, thereby heating the water. In the steady state condition, the water in the lower chamber 51 desirably reaches a temperature on the order of 800° F. while that in the upper chamber remains approximately 400° F. The lower chamber water at a pressure of 2000 psi and a temperature of 800° F. is continually forced downward through the orifice 77 to a point outside the lower chamber 51, where it immediately flashes to high-pressure steam due to the sudden decrease in the surrounding pressure. The steam is thus directed downward from the orifice, from where it diffuses into the formation. The downward direction of the steam is highly advantageous in the case of high energy steam to avoid damage to the well casing or undue upward steam pressure, which can result from the emission of steam to the side or to the top, respectively. Heating the relatively cool incoming water as it flows past the electrodes 93 prevents the formation of highly ionized gaseous conditions, or plasmas, which can be highly disruptive and dangerous in the operation of a boiler of this type. The incoming water is heated essentially once as it passes along the flow chamber 63 and exits through the open ends 71 at a temperature approximately equal to the remainder of the water in the lower chamber 51. The temperature in the lower chamber 51 is thus maintained in an essentially uniform condition.

Under operating conditions, the expandable seal 95 is forced outward against the interior of the well casing with a pressure equal to that of the incoming pressurized water. The expandable seal structure of the present invention therefore automatically compensates for a change in input water pressure which will increase or decrease the pressure of the steam produced by the tool. The stability of the tool and the fluid seal against the interior of the well casing is thus varied automatically in proportion to changes in steam conditions caused by input water pressure fluctuations. When the tool is shut down, the water pressure therein subsides and the expandable seal 95 assumes the retracted, broken line condition shown in FIG. 5A.

It will be understood that the shell 10 may have more than one downward directed orifice for the production of high pressure steam. The shell 10 may also include a plurality of valved orifices (not shown) in the wall element 31 to produce lateral jets of steam when necessary to free the tool from accumulated tars and paraffins within the bore hole. The valved orifices may be similar to the steam outlets 76 shown in FIG. 5 with corresponding valve regulators 78, however the valve regulators in this case would be actuable by an operator at the surface.

Figure 9:
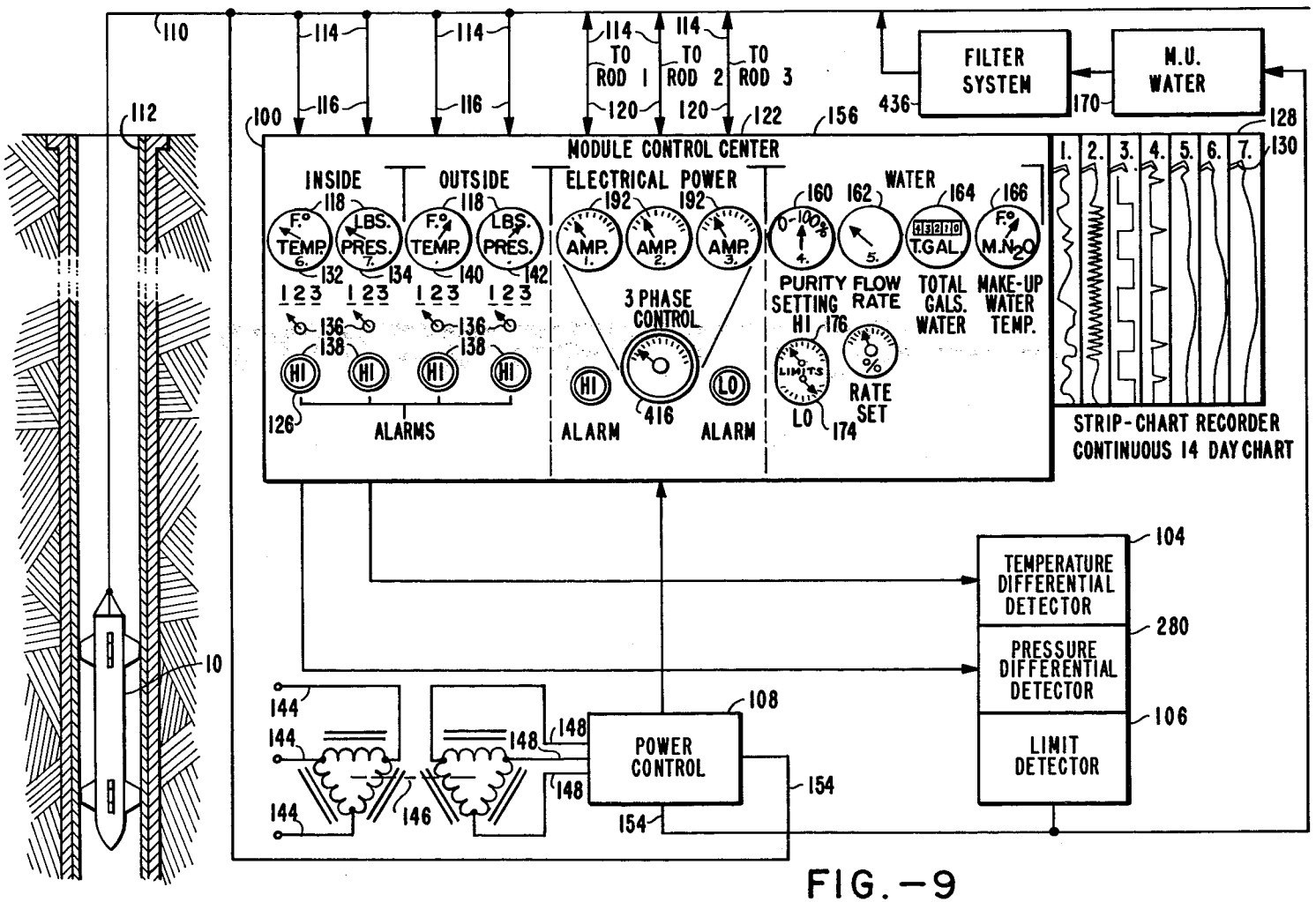
FIG. 9 is a diagrammatic representation of a well steaming apparatus constructed in accordance with the invention.

The well steaming apparatus of FIG. 9 may be seen to consist essentially of the tool or probe 10, a control panel 100, a water system 102, a differential detector 104, a double-ended limit detector 106, and a power control 108. A cable 110 is attached to the probe 10 for lowering the probe into the earth through the well casing 112. Electrical lines 114 to passages 16 and 24, which can best be seen in FIG. 1, run with the cable 110 and provide electrical connection between the various components of tool 10 and the remainder of the apparatus. Electrical lines 114 may include, among others, four sets 116 of three lines each running to temperature and pressure gauges 118 on control panel 100 and three relatively heavy conductors 120 running to three-phase electrical power section 122 of the panel. Water line 18 and vacuum line 22 also run with cable 110 to introduce water to and remove water from the area of tool 10 in well casing 112. Control panel 100 thereby monitors the various conditions critical to the production of steam by tool 10 and controls the various functions of the network in conjunction with differential detector 104 and limit detector 106. Power for these purposes is supplied by power control 108.

Control panel 100 can be seen to include a plurality of gauges 124 and alarms 126 indicating conditions at various locations in the apparatus. It receives signals from sensors 80 or sensors 41 and 43 for this purpose via the electrical lines 114 discussed above. It also has a conventional strip chart recorder 128 which records the most important of those conditions while the network is in operation. Strip chart recorder 128 is provided with a plurality of pens 130, each of which is constructed to record a different characteristic of the apparatus as a function of time on a passing piece of paper. This is done by causing the pen to move a distance corresponding to the changes in that characteristic along a line perpendicular to the direction of movement of the paper. The recorder may be constructed to operate continuously for 14 days, the time necessary to complete a steaming operation. A permanent and continuous record of conditions is thus obtainable.

Water system 102 is actuable automatically to provide the desired amount of water to tool 10 via water line 18 during operation of the apparatus.

Control panel 100 is provided with "inside" temperature and pressure gauges 132 and 134, respectively, each of which is provided with a three-position switch 136 and an alarm 138. Each gauge can be placed in communication with any one of the resistive sensors within the tool 10 by appropriately positioning switch 136. The sensors are located within tool 10 and certain of them are adapted to measure the internal temperature or pressure at corresponding locations therein. Alarms 138, which are shown as lights, are activated when the temperature or pressure at any point exceeds a predetermined value. Those alarms may also be audio in nature. Other of the temperature and pressure sensors may be adapted to measure the external temperature or pressure around tool 10. They are connected to temperature and pressure gauges 140 and 142 which are also provided with switches 136 and 138 identical to those described above.

The electrical power section 122 of control panel 100 acts in conjunction with power control 108 to provide electric power to the entire apparatus. High voltage three-phase power is applied to wires 144, leading to the primary coils of three-phase power transformer 146. The secondary coils of that transformer are connected to power control 108 by wires 148. Power control 108 is regulated through lines 150 and 152 as discussed below. The entire apparatus is powered through output lines 154.

Water section 156 of control panel 100 displays the characteristics of the water which flows to tool 10 via water line 158. It includes water purity gauge 160, flow rate meter 162, total gallonage meter 164 and make-up water temperature gauge 166. Flow rate meter 162 and total gallonage meter 164 are connected in series along water line 158 to register the water flow to tool 10. The flow rate is at the same time recorded by one of strip chart recording pens 130.

Figure 12:
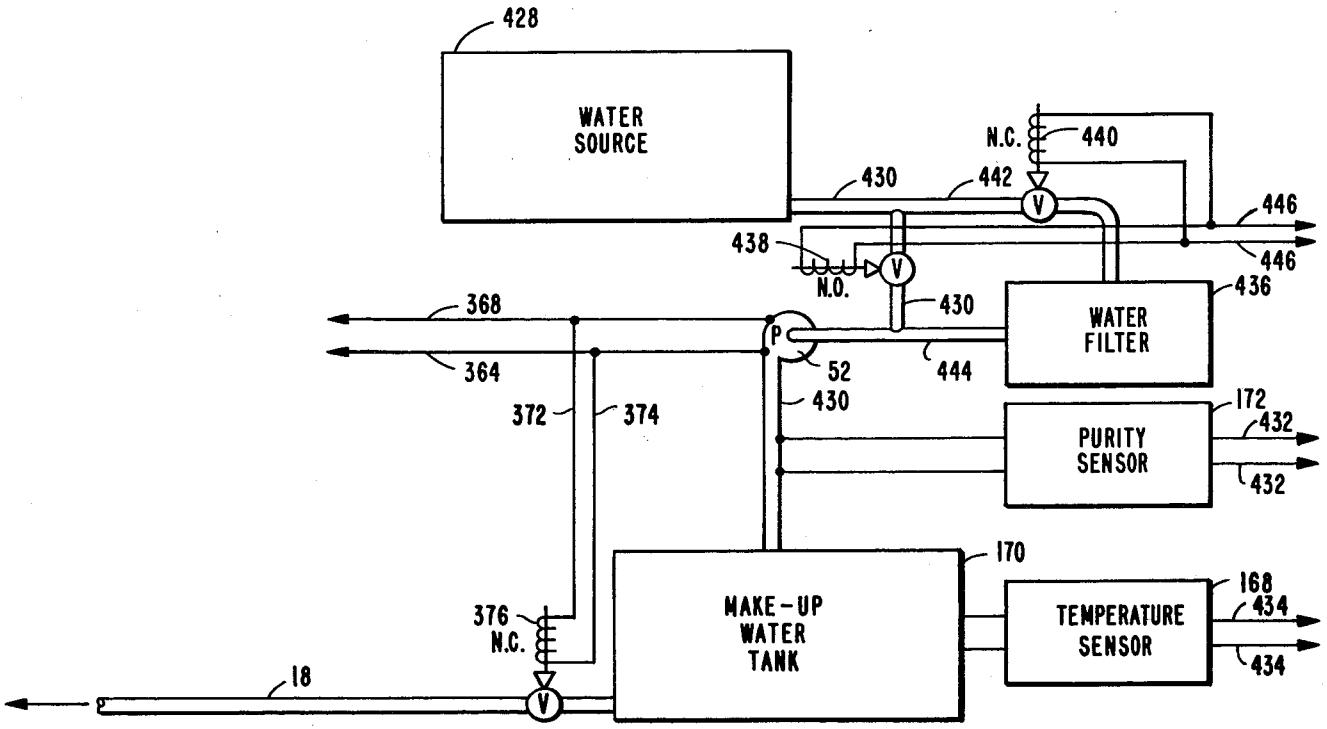
FIG. 12 shows the water supply system of the apparatus of FIG. 9.

Make-up water temperature gauge 166 operates on a signal from make-up water temperature sensor 168 of FIG. 12 to indicate the temperature of the water in make-up tank 170 which supplies water line 18. Sensor 168 might also serve as a sensor for an apparatus to automatically heat that water in order to reduce the temperature differential between the water pumped to the probe and the probe itself. This might be desirable to reduce the shock on tool 10 of sudden temperature changes and to reduce the likelihood of underground explosions of combustibles within the well.

Purity gauge 160 responds to a signal from purity sensor 172 of FIG. 12, which sensor determines the purity of the water being supplied by measuring its conductivity. That level of purity is both displayed on gauge 160 and recorded by strip chart recorder 128. Knobs 174 and 176, located directly beneath purity gauge 160, control double-ended limit detector 106 of FIG. 10. Those knobs allow an operator to manually set minimum and maximum water purity levels at which the apparatus may be operated. Both upper and lower limits may be placed on water purity to keep chemical deposits at a minimum while assuring that the water will be conductive enough to allow efficient operation of the three electrode heating system.

The various components of the well steaming apparatus are interconnected as shown in FIG. 9 to form a unified system to monitor and control a steaming operation. The individual connectors and their purposes will be best understood in the context of the following discussion of each component.

Figure 10:
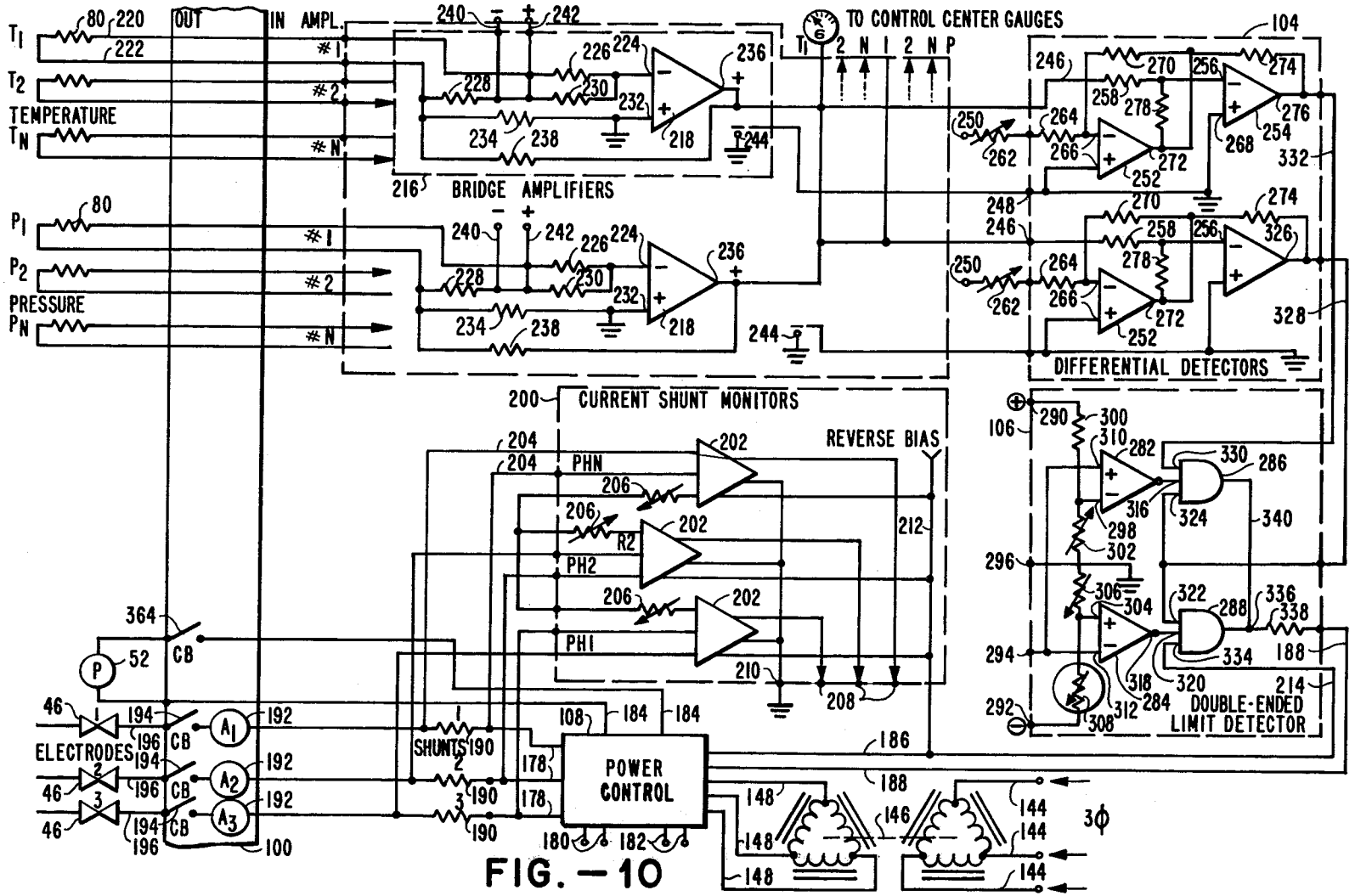
FIG. 10 is a schematic representation of much of the control circuitry of the apparatus of FIG. 9.

Referring now to FIG. 10, three-phase transformer 146 is connected to the three power input lines 148 of power control 108. Power control 108 has three regulated three-phase output lines 178 corresponding to the different phases of the input power lines 180, 182 and 184. Input lines 186 and 188 control the power to all of the above output lines except lines 180 and 182, which are always powered. Each of the three-phase output lines 178 includes in series connection a shunt resistor 190, an ammeter 192 described above and a circuit breaker 194. Lines 178 are connected to lines 196 which run with cable 110 to tool 10. Within tool 10 the wires are attached to heating electrodes 46 or 93 for the production of steam. The circuit breakers 194 allow a single electrode to be manually or automatically disconnected in the event of an excessive current without the necessity for shutting down the entire system. The remaining electrodes can therefore remain functioning to produce steam.

Current shunt monitor circuit 200 includes three industrial current shunt monitor amplifiers 202 to indicate and provide regulation to the current flow from power control 108 through lines 178. Each monitor has two input leads 204 which are connected across a different one of the resistors 190.

A third lead of each is connected to a separate variable resistor 206 whose opposite end is grounded. Those resistors may then be adjusted separately to vary the relative currents flowing to the three electrodes. The outputs 208 of amplifiers 202 go respectively to three separate pens 130 of strip recorder 128 to record the current flow over time. There is also a common ground 210. The reverse bias lead of each amplifier is connected to a common reverse bias line 212. That line will be positive while the amplifiers are operating within a predetermined current range, but will go negative if that range is exceeded. Line 212 is connected to power control input line 186 and limit detector input line 214.

Temperature and pressure sensors 80, or sensors 41 and 43 in the embodiment of FIGS. 5A, 6A and 8A, are located within tool 10 and are connected to lines 114 for communication with control panel 100. The sensors are of the simple resistive type. The signal from each is amplified by a separate bridge amplifier 218 for signal amplification. For example, one temperature sensor is connected to bridge amplifier 216 by two conductors 220 and 222. Conductor 220 is connected to the "−" terminal 224 of operational amplifier 218 through resistor 226, and conductor 222 is connected to the same terminal through the series combination of resistors 228 and 230 in that order. Conductor 222 is also connected to the "+" terminal 232 of operational amplifier 218 through resistor 234, which terminal is grounded, and to the output terminal 236 of that same amplifier through resistor 238. The amplifier is powered through leads 240 and 242, with lead 242 being positive. Lead 242 is connected directly to conductor 220 and lead 240 is connected to the junction between resistors 228 and 230. The output terminal 236 is positive with reference to ground terminal 224. Temperature gauge 132, two inputs to strip chart resistor 128, and inputs 246 and 248 of differential detector 104 are connected in parallel across output terminal 238 and ground terminal 244. Gauge 132 therefore registers the temperature at a first position in tool 10 while strip chart recorder 128 records that temperature over time.

A part of the signal passes through differential detector 104 for comparison therein to a reference voltage for determination of whether the temperature differs from that reference by more than a predetermined acceptable amount. That reference voltage is produced by the application of a positive voltage to terminal 250 with reference to common ground 248. Differential detector 104 is itself a commercially available unit using a pair of operational amplifiers 252 and 254 similar to operational amplifier 218 of bridge amplifier 216. Terminal 246 is connected to the "−" input terminal 256 of amplifier 254 through a resistor 258 which may have a resistive value of $R_1$. Terminal 250 is connected to the "−" input terminal 260 of amplifier 252 through a series combination of a variable resistor 262 and a resistor 264 which has the same value of $R_1$. Terminal 248 is connected to ground and to the two "+" input terminals 266 and 268 of amplifiers 252 and 254, respectively. Resistor 270, with a value of $R_1$, is connected between the "−" input terminal 260 and the output terminal 272 of amplifier 252, and resistor 274 is connected between output terminals 272 and 276. Finally, resistor 278 is connected between the output terminal 272 of amplifier 252 and the "−" input terminal 256 of amplifier 254. Output terminal 276 of amplifier 254 is therefore also the output of differential detector 104.

The acceptable temperature range is programmed into the detector by adjustment of variable resistor 262. Differential detector 104 will then cause a positive signal to be applied to output terminal 276 whenever the temperature is in tolerance and a negative signal when the temperature differs from the optimum by an excessive amount. It is those signals which automatically control the power to the probe as discussed below.

One pressure sensor is connected to a circuit identical to the one discussed above, including an identical differential detector 280 whose output varies similarly between the positive and negative. The only difference is that the voltage drop across the sensor represents a particular pressure rather than temperature. The output of that sensor is also recorded by strip chart recorder 128 over time.

Each of the other temperature and pressure sensors communicates with a separate bridge amplifier (not shown) which is identical to those described above, but which does not feed into a differential detector. Those amplifiers are connected only to gauges 118 through three-position switches 136 of FIG. 9. Their signals thus can be read out on control panel 100, but do not control electrode power. That is done entirely by the two sensors which feed into their respective differential detectors 104 and 280. Because the readings from many of the differently located sensors will be approximately the same, two are relied upon as representative for control purposes. The same two are also the only ones of which a permanent record is maintained by strip chart recorder 128.

Double-ended limit detector 106 is a commercially available unit which is designed to indicate whether or not a given input is within an acceptable range or "window". If it is, and if all other conditions are satisfactory, a positive output is produced. If something is unsatisfactory, no output is produced. The output is used here essentially to determine whether the purity of water coming into the apparatus is within the necessary limits and to appropriately regulate the power provided to electrodes 198 and water system 102 by power control 108.

Limit detector 106 uses operational amplifiers 282 and 284 in conjunction with two three-input "and" gates 286 and 288 whose center inputs are inverted as shown. Power is supplied to the detector through lines 290 and 292 according to the polarity indicated. An input signal is supplied to detector 106 from purity sensor 172 of FIG. 12 through lines 294 and 296 according to the polarity indicated. The "−" input terminal 298 of amplifier 282 is connected to line 290 by a fixed resistor 300 and to line 296 by a variable resistor 302. The "+" input terminal 304 of amplifier 284 is connected to line 296 by a variable resistor 306 and to line 292 by a variable resistor 308. The "+" input terminal 310 of amplifier 282 and the "−" input terminal 312 of amplifier 284 are both connected to line 294. Line 296 is grounded. The output terminal 314 of amplifier 284 is connected to the inverted terminal 316 of gate 286 and the output terminal 318 of amplifier 284 is connected to the inverted terminal 320 of gate 288. Terminal 322 of gate 288 and terminal 324 of gate 286 are connected to the output 326 of pressure differential detector 280 via line 328. Terminal 330 of gate 286 is connected to the output terminal 276 of temperature differential detector 104 via line 332, while terminal 334 of gate 288 is connected to the reverse bias line 212 of current shunt monitor 200 through line 214. Gates 286 and 288 have a common output 336 which is connected to power control input line 188 via resistor 338.

Resistor 300 and variable resistor 308 establish the gain of amplifiers 282 and 284 in this configuration, with the variability of resistor 308 enabling the circuit to be balanced after assembly. Variable resistors 302 and 306, on the other hand, establish the high and low water purity limits, respectively, which are considered acceptable. A negative signal will be present at the output terminal 314 of amplifier 282 only if the purity is less than the high limit and a negative signal will be present at the output terminal 318 of amplifier 284 only if the purity is greater than the low limit. Otherwise, those signals will be positive. Since amplifier outputs 314 and 318 feed into the center inverted input terminals of gates 286 and 288, their values are inverted. They act as positive signals in the "and" logic of the gates when the purity is within its limits and as negative signals when those limits are exceeded. The inputs from differential detectors 104 and 280 and from current shunt monitor reverse bias line 212 are also positive when the apparatus is functioning within its limits and negative when those limits are exceeded. Because the output terminals of the two gates are shorted by line 340, those two gates operate as a single large "and" gate. This is because one gate will be grounded if its inputs are not all satisfactory, thereby destroying the signal from the other gate. Satisfactory inputs must be applied to each of the six input terminals of gates 286 and 288 to produce a positive output in line 188 to power control 108.

Figure 11:
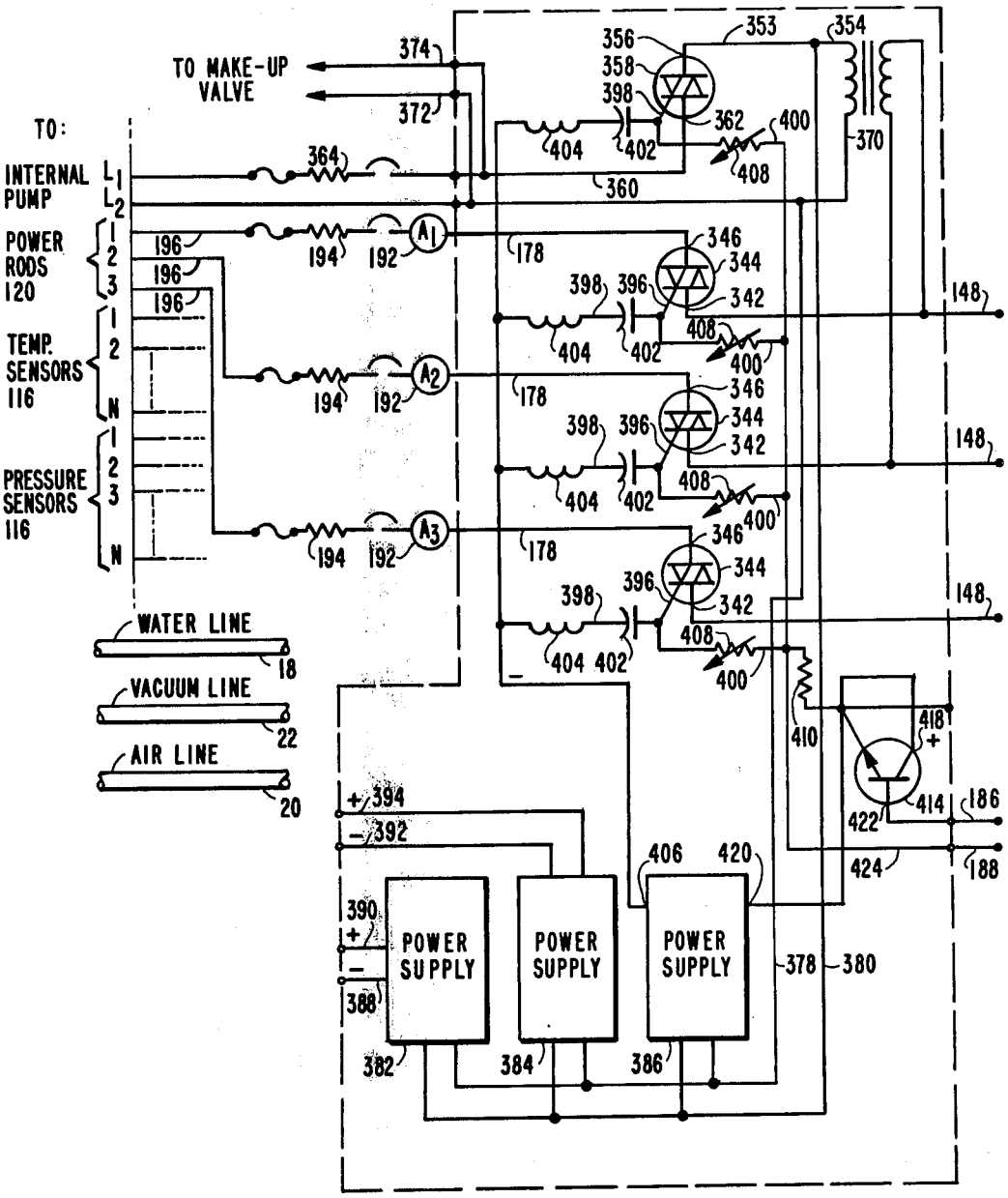
FIG. 11 is a schematic representation of the power control depicted in FIGS. 9 and 10.

Power control 108 is shown in detail in FIG. 11. It receives three-phase power through power lines 144 and transformer 146, as discussed in relation to FIG. 9. That transformer is connected to lines 148 which are connected to power input terminals 342 of three high voltage triacs 344. The power output terminals 346 of those triacs are connected to three-phase output lines 178. Each of those lines runs to an ammeter 192 and circuit breaker 194, at which point it is connected to one of lines 196 for the supply of power to an electrode as discussed above.

Lines 348 and 350 are connected at one end to two of the three-phase lines 148, and at the other end to the primary coil of single-phase transformer 352. Line 353 is connected between terminal 354 of the secondary coil of transformer 352 and power input terminal 356 of triac 358. Line 360 leads from the power output terminal 362 of that triac and is connected through circuit breaker 364 to one terminal of the water pump 52 which is internal to tool 10 in the first embodiment, or to water pump 451 located above ground. Line 368 running from terminal 370 of the secondary coil of transformer 352 is connected to the other terminal of the pump 52 or the pump 451. Wires 372 and 374, connected to lines 364 and 368, respectively, lead to make-up water valve 376 as discussed in relation to FIG. 12. Single phase power is thereby supplied to the pump 52 or 451 and the water valve 376 whenever the regulated power circuit of triac 358 is open.

Lines 378 and 380 are connected across the secondary coil of transformer 352 in parallel to the regulated pump circuit. Those lines, which are unregulated, are connected at their other ends to a parallel combination of the inputs of voltage regulated power supplies 382, 384 and 386. Terminals 236 and 244 of each bridge amplifier 216 of FIG. 10 and terminals 246 and 248 of the two differential detectors of that same figure are connected in parallel across output lines 388 and 390 of power supply 382. Lines 290 and 292 of double-ended limit detector 106 are connected to output lines 392 and 394 of power supply 384. In this way, the proper voltages are supplied to bridge amplifiers 216, differential detectors 104 and 280, and double-ended limit detector 106 are connected to output lines 392 and 394 of power supply 384. In this way, the proper voltages are supplied to bridge amplifiers 216, differential detectors 104 and 280, and double-ended limit detector 106 at all times. They must remain operative after the power to the electrodes has been cut off to analyze data and restart the system when all systems are satisfactory.

Voltage regulated power supply 386 powers the circuit which opens and closes the power gates of triacs 344 and triac 358. The control electrode 396 of each triac has leads 398 and 400 connected to it. Lead 398 of each has a separate capacitor 402 and inductor 404 in series and is connected at its opposite end to the negative terminal 406 of power supply 386. Lead 400 of each has a separate variable series resistor 408 in it. The opposite ends of each is connected to resistor 410 at junction 412. Resistor 410 leads to the emitter electrode of an npn transistor 414. The three variable resistors 408 of triacs 344 may be combined as one triple-ganged rheostat 416, illustrated in FIG. 9. The collector terminal 418 of transistor 414 is connected to positive terminal 420 of power supply 386, while its base terminal 422 is connected to power control input line 186 discussed above. That line receives a signal from reverse bias line 212 of FIG. 10. Line 424 runs from junction 412 to power control input line 188 and receives a signal from output 336 of double-ended limit detector 106.

Three-phase power is therefore provided to electrodes 46 or 93 whenever a positive voltage is applied to power control input line 186 by reverse bias line 212 and a negative voltage is not applied to power control input line 188. In that condition, a positive current from power supply 386 flows from the collector to the emitter of transistor 414 and from there to control electrodes 396 of triacs 344. That current will open the "gate" of those triacs, allowing a high current to flow therethrough. The rate of that flow can be varied by adjustment of resistors 408 through triple-ganged rheostat 416. On the other hand, the current through triacs 344 will be shut off if power control input line 188 is grounded or if the positive signal on power control input line 186 ceases. These conditions indicate that too much current is being drawn by the electrodes or that the range allowed for some condition of the system has been exceeded, respectively.

Single phase power is provided to the other electrical aspects of the apparatus through transformer 352. That power is applied directly to power supplies 382, 384 and 386, as discussed above, and to pump 52 or 451 and make-up valve 376 through triac 358. The power through triac 358 is regulated in exactly the same way and responsive to the same conditions as that through triacs 344. Its level when the "gate" of triac 358 is open is determined by the adjustment of resistor 408, which may be an internal adjustment.

Cable 110 is shown diagrammatically in FIG. 11, along with the various lines which run with it down well casing 112 to tool 10. Line 20 provides air for the operation of air-operated solenoid valve 68 in line 18. Vacuum line 22 is included for the purpose of providing a route for escape of air from the area of the probe. When needed, it may be connected to any available vacuum source at the surface. A pump for that purpose may, of course, be incorporated into the apparatus described here.

Water source 428 of FIG. 12 provides water to make-up water tank 170 through pipes 430. Pump 52 or 451 is operatively connected to pipe 430. Water line 18, which is filled with a normally closed electrically-operated water valve 376 adjacent make-up water tank 170, leads from that tank to tool 10. A second air-operated electrical water valve 68 is located within said probe for shutting off the flow of water from line 18. Pump 52 or 451 and water valve 376 receive electric power from lines 364 and 368, across which they are connected in parallel. Air-operated valve 68 may be actuated by a simple mechanism responsive to the signal in lines 364 and 368 as well. The pump is therefore powered and the valves 376 and 68 are open whenever electrodes 46 or 93 are powered. Purity sensor 172 is a simple water conductivity sensor. It measures the purity of the water coming from the pump and sends a signal along lines 432 to terminals 294 and 296 of double-ended limit detector 106 for regulation of power control 108. Temperature sensor 168 is a resistive type sensor positioned to measure the temperature of the make-up water. Its signal operates make-up water temperature gauge 166 via lines 434.

Water filter 436 and electrically-operated water valves 438 and 440 cause the water to be filtered when its purity level becomes too low. Valve 438 is normally open and is located within pipe 430 at a point ahead of pump 52 or 451. Valve 440 is normally closed and is located in pipe 442 which branches off from pipe 430 ahead of valve 438 and leads to the input side of water filter 436. Pipe 444 then leads from the output of filter 436 to a point where it branches into pipe 430 on the opposite side of valve 438 but still ahead of the pump. The electrical leads of valves 438 and 440 are connected in parallel across lines 446. When no power is applied to lines 446, water therefore is pumped directly from source 428 to make-up tank 170 through pipe 430. When power is applied, valve 438 closes and valve 440 opens, causing water to be pumped through pipe 442, filter 436 and pipe 444 for purification. This application of power may be made manually or through a simple addition to purity sensor 172. In the latter case, the water could be automatically purified when water purity goes below a predetermined level.

In operation, three-phase power applied to wires 148 provides power immediately to the monitoring phase of the system through transformer 352 and voltage regulated power supplies 382, 384 and 386. The signals from the temperature and pressure sensors are therefore amplified by bridge amplifiers 216 and are passed through differential detectors 104 and 280 to assure that they are within their acceptable ranges. If they are satisfactory, positive inputs are supplied terminals 324 and 330 of gate 286 and terminal 322 of gate 288. At the same time, the signal from purity sensor 172 is evaluated by double-ended limit detector 106 to determine whether they are within the "window" desired. If so, negative signals are applied to the center inverted terminals 316 and 320 of gates 286 and 288, respectively. Those signals become the equivalent of positive signals in the "and" logic of the gates. The signal from reverse bias line 212 to terminal 334 of gate 288 is positive when the electrode current is satisfactory. The "and" logic of gates 286 and 288 is therefore satisfied when all monitored systems are within their limits. This results in a positive signal to power supply input line 188, opening the gates to triacs 344 and triac 358. The system is then fully operational.

If either the temperature, pressure, water purity or electrode current gets out of tolerence, the system is placed in a "standby" mode wherein triodes 344 cut off the current to electrodes 46 or 93, pump 52 or 451, and water valves 376 and 68. This is caused by one of the inputs to gate 286 or gate 288 changing its sign. After the particular condition subsides, the appropriate sensor will note that the condition is now satisfactory and gates 286 and 288 will again produce a positive output. That will re-open the triacs and the apparatus will recommence making steam. In this way, the system can operate indefinitely without human intervention.

Figures 13, 13A:
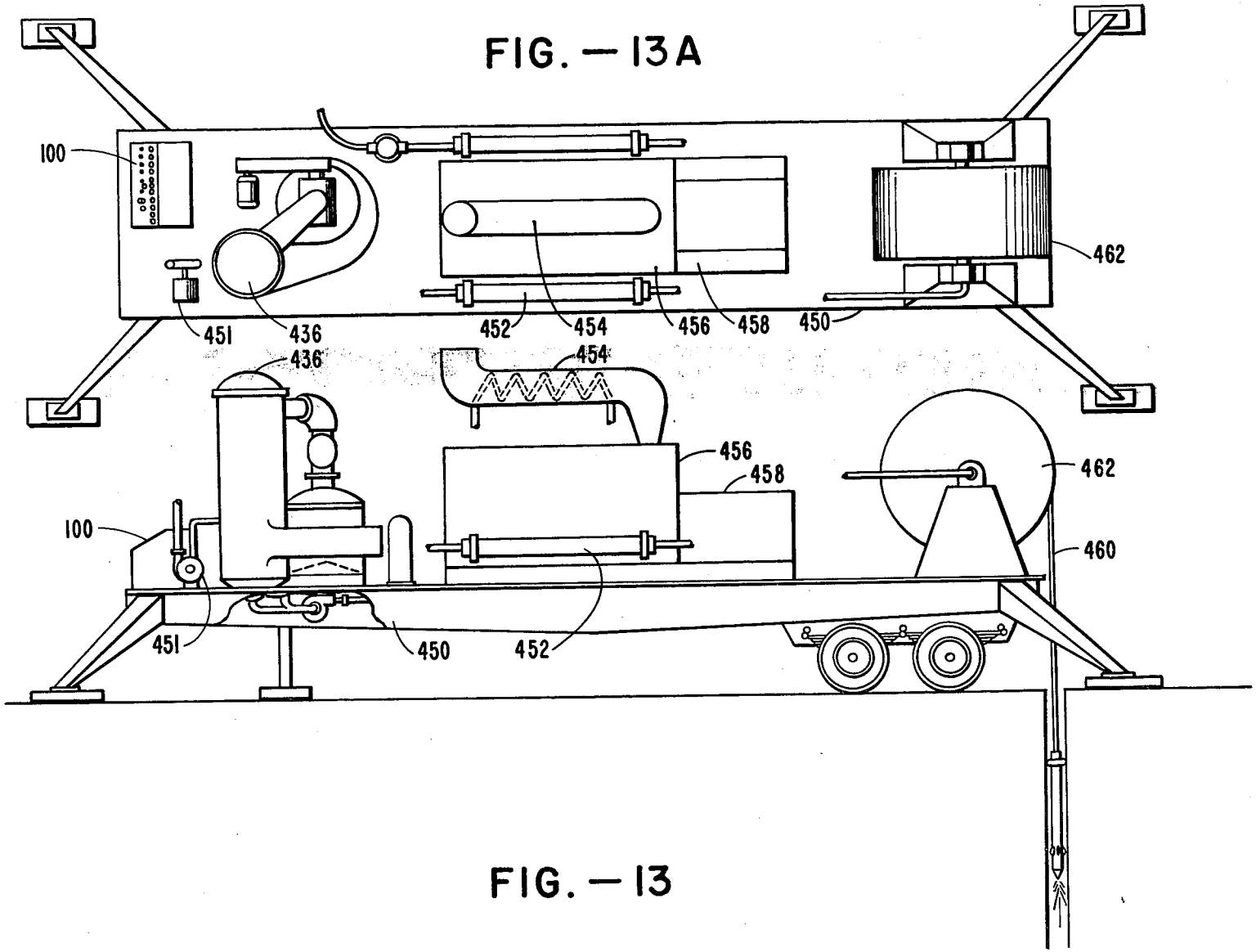
FIG. 13 is a side elevational view showing the above-ground portion of the novel oil tool apparatus of the present invention.
FIG. 13A is a top plan view showing the apparatus of FIG. 13.

FIGS. 13 and 13A illustrate the entire above-ground apparatus of the present invention. It is shown installed on a flatbed trailer 450 to enable it to be easily transported from one site to another for the performance of the steaming operation on a variety of wells. The water pump 451 pumps water from a brackish or other polluted source through the water purity system 436 which strains and evaporates the water to a condition of very high purity. In the embodiment of FIGS. 5A, 6A and 8A, the pump 451 is a very high pressure pump capable of producing a pressure of at least 2000 psi. The water is then passed through heat exchangers 452 and 454 which utilize the waste heat of a diesel engine 456 to raise the temperature of the water to approximately 400° F. before it is pumped to the tool 10 within the well casing through a composite cable assembly 460 mounted on a reel 462. The diesel engine 456 drives a three-phase electrical generator 458 to produce the electrical power for the entire apparatus. Electrical power from the generator 458 is supplied to the electrodes by an electrically conductive portion of the cable assembly 460.

Having fully described the invention, it is intended that it be limited only by the lawful scope of the appended claims.

We claim:

1. A novel oil well tool comprising:

an external elongated shell adapted to be received within a bore hole traversing an oil field;

means for introducing liquid water into said shell in situ within the bore hole in heat transfer proximity to a pay zone of the oil field;

within said shell, electrically powered means for transforming said liquid water into at least one jet of high pressure steam directed downward from said shell in said bore hole.

2. A novel oil well tool comprising an external elongated generally cylindrical shell adapted to be received within a bore hole traversing an oil field and suspended therein, said shell having a main cavity adapted to contain high pressure liquid water and being substantially impervious to and a barrier against the ambient fluids within the bore hole;

within said main cavity, at least one electrode means longitudinally disposed within said shell, including a central electrode element concentric with a cylindrical sleeve element to form a pair of opposing cylindrical surfaces which define an annular region for water flow;

means for introducing conditioned high pressure liquid water into said main cavity such that said water passes through said annular region before passing to the remainder of said main cavity;

means for causing a multiple-phase electrical current capable of superheating said water to flow between said surfaces and through said water;

said shell having at least one orifice directed downwardly at the bottom thereof by which said main cavity communicates with the bore hole;

whereby high pressure liquid water in a superheated condition is forced through said at least one orifice and into the bore hole where it immediately flashes to high pressure steam;

means for centering said shell within the bore hole and allowing longitudinal movement of said shell therealong;

means for lowering, suspending or raising said shell within the bore hole while steam flows therefrom into the pay zone; and a device capable of monitoring at least one variable condition in the operation of said tool and adapted to automatically disconnect electric power from a portion of said tool in response to an undesired status of said variable condition and to reconnect that electric power in response to the return of said variable condition to a desired status.

3. An apparatus as recited in claim 2 in which the undesired status of said variable condition comprises a value of said variable condition which differs from an optimum value by more than a predetermined acceptable amount.

4. The apparatus of claim 3 wherein said variable condition is the temperature of said liquid water and said undesired status is a temperature value varying from an optimum value by more than a predetermined amount.

5. The apparatus of claim 4 wherein said variable condition is the pressure of said liquid water and said undesired status is a pressure value varying from an optimum value by more than a predetermined amount.

6. The apparatus of claim 5 wherein said variable condition is the purity of said liquid water and said undesired status is a value less than a predetermined minimum or greater than a predetermined maximum allowable value.

7. The apparatus of claim 6 wherein said variable condition is the magnitude of the electric power flowing to said electrode means and said undesired status is a power level greater than a predetermined allowable maximum.

8. The apparatus of claim 7 wherein said shell further comprises:

inflatable means extending circumferentially from said shell at a point above said at least one orifice and expandable to a fluid sealing condition with the inner wall of the bore hole upon the introduction of high pressure liquid water into said inflatable means; and means for introducing high pressure liquid water into said inflatable means;

whereby said bore hole is effectively sealed off at a point above said at least one orifice to prevent the escape of the steam up the bore hole.

9. The apparatus of claim 8 wherein said means for introducing high pressure liquid water into said inflatable means includes a portion of said shell forming an auxiliary cavity in communication with said water introduction means and with the interior of said inflatable means.

10. A novel oil well tool comprising an external elongated shell adapted to be received within a bore hole traversing an oil field and suspended in situ within said bore hole in heat transfer proximity to a pay zone of the oil field, said shell having a main cavity adapted to contain high pressure liquid water and being substantially impervious to and a barrier gainst the ambient fluids within the bore hole;

within said main cavity, at least one electrode means longitudinally disposed within said shell, including a central electrode element surrounded by a cylindrical sleeve element to form a pair of opposing cylindrical surfaces which define an annular region for water flow;

means for introducing high pressure liquid water into said main cavity such that at least some of said water passes through said annular region and into the remainder of said main cavity;

means for causing an electrical current capable of superheating said water to flow between said surfaces and through said water;

said shell having at least one orifice by which said main cavity communicates with the bore hole;

whereby high pressure liquid water in a superheated condition is forced through said at least one orifice and into the bore hole where it immediately flashes to high pressure steam.

11. A novel oil well tool comprising an external elongated shell adapted to be received within a bore hole traversing an oil field, said shell adapted to contain high pressure liquid water and being substantially impervious to and a barrier against the ambient fluids within the bore hole;

means for introducing high pressure liquid water into said shell in situ within said bore hole in heat transfer proximity to a pay zone of the oil field;

within said shell, means for superheating said high pressure liquid water;

said shell having at least one orifice by which said main cavity communicates with the bore hole;

whereby high pressure liquid water in a superheated condition is forced through said at least one orifice and into the bore hole where it immediately flashes to high pressure steam;

inflatable means extending circumferentially from said shell at a point above said at least one orifice and expandable to a fluid sealing condition with the inner wall of the bore hole upon the introduction of high pressure liquid water into said inflatable means; and means for introducing high pressure liquid water into said inflatable means;

whereby said bore hole is effectively sealed off at a point above said at least one orifice to prevent the escape of said steam up the bore hole.

12. The apparatus of claim 11 wherein said means for introducing high pressure liquid water into said inflatable means includes a portion of said shell forming an auxiliary cavity in communication with said water introduction means and with the interior of said inflatable means.

13. A novel oil well tool comprising an external elongated shell adapted to be received within a bore hole traversing an oil field, said shell adapted to contain high pressure liquid water and being substantially impervious to and a barrier against the ambient fluids within the bore hole;

means for introducing high pressure liquid water into said shell in situ within said bore hole in heat transfer proximity to a pay zone of the oil field;

within said shell, means for superheating said high pressure liquid water, including three electrode means disposed longitudinally of said shell and means for applying three phase electrical power to said electrode means;

said shell having at least one orifice by which said main cavity communicates with the bore hole;

whereby high pressure liquid water in a superheated condition is forced through said at least one orifice and into the bore hole where it immediately flashes to high pressure steam.

14. A novel oil well tool comprising an external elongated shell adapted to be received within a bore hole traversing an oil field, said shell adapted to contain high pressure liquid water and being substantially impervious to and a barrier against the ambient fluids within the bore hole;

means for introducing high pressure liquid water into said shell in situ within said bore hole in heat transfer proximity to a pay zone of the oil field, including means for preheating said water;

within said shell, means for superheating said high pressure liquid water;

said shell having at least one orifice by which said main cavity communicates with the bore hole;

whereby high pressure liquid water in a superheated condition is forced through said at least one orifice and into the bore hole where it immediately flashes to high pressure steam.

15. A novel oil well tool comprising an external elongated shell adapted to be received within a bore hole traversing an oil field, said shell adapted to contain high pressure liquid water and being substantially impervious to and a barrier against the ambient fluids within the bore hole;

electrically operated means for introducing high pressure liquid water into said shell in situ within said bore hole in heat transfer proximity to a pay zone of the oil field;

within said shell, electrically operated means for superheating said high pressure liquid water;

said shell having at least one orifice by which said main cavity communicates with the bore hole;

whereby high pressure liquid water in a superheated condition is forced through said at least one orifice and into the bore hole where it immediately flashes to high pressure steam; and a device capable of monitoring the temperature of said liquid water, and adapted to automatically disconnect electric power from at least one of said electrically operated means in response to a temperature outside a predetermined optimum range and to automatically reconnect said electric power in response to the return of said temperature to said optimum range.

16. A novel oil well tool comprising an external elongated shell adapted to be received within a bore hole traversing an oil field, said shell adapted to contain high pressure liquid water and being substantially impervious to and a barrier against the ambient fluids within the bore hole;

electrically operated means for introducing high pressure liquid water into said shell in situ within said bore hole in heat transfer proximity to a pay zone of the oil field;

within said shell, electrically operated means for superheating said high pressure liquid water;

said shell having at least one orifice by which said main cavity communicates with the bore hole;

whereby high pressure liquid water in a superheated condition is forced through said at least one orifice and into the bore hole where it immediately flashes to high pressure steam; and a device capable of monitoring the pressure of said liquid water, and adapted to automatically disconnect electric power from at least one of said electrically operated means in response to a pressure outside a predetermined optimum range and to automatically reconnect said electric power in response to the return of said pressure to said optimum range.

17. A novel oil well tool comprising an external elongated shell adapted to be received within a bore hole traversing an oil field, said shell adapted to contain high pressure liquid water and being substantially impervious to and a barrier against the ambient fluids within the bore hole;

electrically operated means for introducing high pressure liquid water into said shell in situ within said bore hole in heat transfer proximity to a pay zone of the oil field;

within said shell, electrically operated means for superheating said high pressure liquid water;

said shell having at least one orifice by which said main cavity communicates with the bore hole;

whereby high pressure liquid water in a superheated condition is forced through said at least one orifice and into the bore hole where it immediately flashes to high pressure steam; and a device capable of monitoring the purity of said liquid water, and adapted to automatically disconnect electric power from at least one of said electrically operated means in response to a purity value less than a predetermined minimum or greater than a predetermined maximum allowable value and to automatically reconnect said electric power in response to the return of said purity to a value between said minimum and maximum values.

18. A novel oil well tool comprising an external elongated shell adapted to be received within a bore hole traversing an oil field, said shell adapted to contain high pressure liquid water and being substantially impervious to and a barrier against the ambient fluids within the bore hole;

electrically operated means for introducing high pressure liquid water into said shell in situ within said bore hole in heat transfer proximity to a pay zone of the oil field;

within said shell, electrically operated means for superheating said high pressure liquid water;

said shell having at least one orifice by which said main cavity communicates with the bore hole;

whereby high pressure liquid water in a superheated condition is forced through said at least one orifice and into the bore hole where it immediately flashes to high pressure steam; and a device capable of monitoring the magnitude of electric power flowing to said superheating means, and adapted to automatically disconnect electric power from at least one of said electrically operated means in response to a magnitude greater than a predetermined allowable maximum value.

19. The method of stimulating the flow of oil in a formation traversed by a bore hole to cause the migration of oil into the bore hole where it is recoverable to the surface by conventional techniques, comprising the steps of:

introducing high pressure liquid water into a vessel in situ within the bore hole in heat transfer proximity to the pay zone of said formation;

superheating said liquid water within the vessel by passing an electrical current through the water between at least two electrically conductive surfaces as the water flows therepast; and permitting the superheated liquid water to pass downwardly from the vessel into the bore hole adjacent to the pay zone through at least one orifice at the bottom of the vessel and there to immediately flash to high pressure steam.

20. The method of claim 19 including the step of continuously and automatically monitoring at least one variable condition related to the production of steam and automatically altering that production according to the status of the variable condition over a period of time.

21. The method of claim 20 wherein the steps of introducing and superheating the high pressure liquid water are carried out by a plurality of electrically operated components and the step of altering the production of steam comprises varying the electric power to at least one of said components in response to an undesired status of said variable condition.

22. The method of claim 20 wherein said variable condition is the temperature of said liquid water.

23. The method of claim 20 wherein said variable condition is the pressure of said liquid water.

24. The method of claim 20 wherein said variable condition is the purity of said liquid water.

25. The method of claim 20 wherein said variable condition is the magnitude of the electrical current between said surfaces.

26. The method of claim 20 which includes lowering or raising said shell within the bore hole while steam flows therefrom into the pay zone.

27. The method of claim 20 wherein said electrical current between said surfaces is produced by a multiple-phase electric power source.

28. The method of claim 20 which includes the step of effectively sealing off the bore hole at a point above said at least one orifice to prevent the escape of steam from the area of the pay zone by introducing said high pressure liquid water into an inflatable annular sealing means extending from the exterior of said shell to cause said sealing means to contact the inner wall of the bore hole in a fluid sealing relation.

29. The method of claim 20 wherein oil is produced from the well in conventional manner after steaming has been carried out for a time sufficient to produce a self-sustainable increased flow of oil from the pay zone into the bore hole as a result of heating.

* * * * *